US008517337B2

(12) United States Patent
Kuehl et al.

(10) Patent No.: US 8,517,337 B2
(45) Date of Patent: Aug. 27, 2013

(54) PROXIMITY SENSOR ENABLED SUBSTANCE COMMUNICATION COUPLING SYSTEM

(75) Inventors: Steven J. Kuehl, Stevensville, MI (US); Richard A. McCoy, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 917 days.

(21) Appl. No.: 12/643,185

(22) Filed: Dec. 21, 2009

(65) Prior Publication Data

US 2011/0146329 A1 Jun. 23, 2011

(51) Int. Cl.
*F16L 37/38* (2006.01)
*B65B 3/00* (2006.01)

(52) U.S. Cl.
USPC ..... 251/149; 141/349; 141/351

(58) Field of Classification Search
USPC ..... 251/65, 149.1, 149.6, 149.7, 149, 251/142; 137/554; 141/349, 351, 198, 192, 141/347
See application file for complete search history.

(56) References Cited

U.S. PATENT DOCUMENTS

| | | | | |
|---|---|---|---|---|
| 1,958,206 | A | | 5/1934 | Rubsam |
| 3,101,984 | A | | 8/1963 | Wieckmann |
| 3,258,553 | A | | 6/1966 | Breslin |
| 3,561,506 | A | | 2/1971 | Johnson |
| 3,710,060 | A | | 1/1973 | Brevick |
| 4,068,179 | A | | 1/1978 | Sample et al. |
| 4,148,536 | A | | 4/1979 | Petropoulsos et al. |
| 4,317,969 | A | | 3/1982 | Riegler et al. |
| 4,445,743 | A | | 5/1984 | Bakker |
| 4,591,732 | A | | 5/1986 | Neuenschwander |
| 4,604,505 | A | | 8/1986 | Henninger |
| 4,663,542 | A | | 5/1987 | Buck et al. |
| 4,844,582 | A | | 7/1989 | Giannini |
| 4,964,891 | A | | 10/1990 | Schaefer |
| 5,031,258 | A | * | 7/1991 | Shaw ..... 4/623 |
| 5,207,148 | A | | 5/1993 | Anderson et al. |
| 5,368,275 | A | * | 11/1994 | Ketcham et al. ..... 251/149.6 |
| 5,385,468 | A | | 1/1995 | Verderber |
| 5,433,623 | A | | 7/1995 | Wakata et al. |
| 5,450,877 | A | * | 9/1995 | Graffin ..... 137/630.14 |
| 5,713,752 | A | | 2/1998 | Leong et al. |
| 5,828,341 | A | | 10/1998 | Delamater |
| 5,953,129 | A | | 9/1999 | Anderlik et al. |
| 6,176,718 | B1 | | 1/2001 | Skarie et al. |
| 6,183,264 | B1 | | 2/2001 | Harsanyi |

(Continued)

FOREIGN PATENT DOCUMENTS

| | | |
|---|---|---|
| EP | 0868077 A2 | 9/1998 |
| JP | 60033716 A | 2/1985 |

(Continued)

*Primary Examiner* — Eric Keasel
*Assistant Examiner* — David Colon Morales
(74) *Attorney, Agent, or Firm* — Clifton G. Green; McGarry Bair PC

(57) ABSTRACT

Systems and components for providing or receiving a substance through a substance communication coupling system. A substance switch is provided for selectively communicating the substance between a first substance communicating device, such as a host or other substance source and a second substance communicating device, such as a substance consumer. The substance switch is activated to transfer a substance in response to detection of a contactless proximity target associated with one of the substance communicating devices by a proximity sensor associated with the other of the substance communicating devices.

42 Claims, 11 Drawing Sheets

(56) References Cited

U.S. PATENT DOCUMENTS 6,350,148 B1 2/2002 Bartolutti et al.
6,359,270 B1 3/2002 Bridson
6,428,334 B1 8/2002 Skarie et al.
6,534,951 B2 3/2003 Kawashima
6,559,882 B1 5/2003 Kerchner
6,633,157 B1 * 10/2003 Yamaki et al. ..... 324/207.2
6,685,491 B2 2/2004 Gergek
6,921,113 B1 * 7/2005 Vlasblom ..... 285/307
6,969,928 B2 11/2005 Hanson
6,973,936 B2 * 12/2005 Watson ..... 137/1
6,981,695 B1 1/2006 Hedlund et al.
6,986,263 B2 1/2006 Crisp, III
7,024,717 B2 4/2006 Hilscher et al.
7,201,005 B2 4/2007 Voglewede et al.
7,207,080 B2 4/2007 Hilscher et al.
7,209,038 B1 4/2007 Deconinck et al.
7,264,026 B2 9/2007 Gruber et al.
7,291,032 B1 11/2007 Carver et al.
7,354,292 B1 4/2008 Lloyd et al.
7,404,298 B2 7/2008 Kim et al.
7,493,926 B2 2/2009 Weglin
7,584,030 B1 9/2009 Graham
7,618,295 B2 11/2009 McCoy
7,625,246 B2 12/2009 McCoy et al.
7,639,485 B2 12/2009 McCoy
7,651,368 B2 1/2010 Kendall et al.
7,686,127 B2 3/2010 LeClear et al.
7,713,090 B2 5/2010 Kendall et al.
7,740,505 B2 6/2010 McCoy
7,740,506 B2 6/2010 McCoy
7,748,494 B2 7/2010 Leclear et al.
7,751,184 B2 7/2010 McCoy
7,765,332 B2 7/2010 McCoy et al.
7,798,865 B2 9/2010 McCoy et al.
7,810,343 B2 10/2010 McCoy et al.
7,814,944 B2 10/2010 Weglin
7,826,203 B2 11/2010 McCoy
7,841,907 B2 11/2010 McCoy
7,843,697 B2 11/2010 McCoy et al.
7,852,619 B2 12/2010 McCoy
7,865,639 B2 1/2011 McCoy et al.
7,869,201 B2 1/2011 McCoy et al.
7,870,753 B2 1/2011 Marcy et al.
7,871,300 B2 1/2011 McCoy et al.
7,898,812 B2 3/2011 McCoy et al.
7,903,397 B2 3/2011 McCoy
7,916,336 B2 3/2011 Silverbrook et al.
7,931,114 B2 4/2011 LeClear et al.
7,934,958 B2 5/2011 Kendall et al.
7,980,088 B2 7/2011 LeClear et al.
8,008,586 B2 8/2011 Kuehl et al.
8,035,958 B2 10/2011 Kendall et al.
8,040,666 B2 10/2011 McCoy et al.
8,151,016 B2 4/2012 McCoy
2001/0017134 A1 8/2001 Bahr
2002/0022991 A1 2/2002 Sharood et al.
2003/0037447 A1 2/2003 Gruber et al.
2003/0154338 A1 8/2003 Boz et al.
2003/0221616 A1 * 12/2003 Carpenter et al. ..... 118/715
2004/0036273 A1 * 2/2004 McClary ..... 285/18
2004/0154318 A1 8/2004 Roh et al.
2004/0202421 A1 10/2004 Iiduka et al.
2005/0011205 A1 1/2005 Holmes et al.
2006/0021659 A1 * 2/2006 Andersson ..... 137/515
2006/0053655 A1 3/2006 Weglin
2006/0118694 A1 6/2006 Lee et al.
2006/0125360 A1 6/2006 Kim et al.
2006/0168236 A1 7/2006 Higuma et al.
2006/0187080 A1 8/2006 Slatter
2007/0086151 A1 4/2007 Oh et al.
2008/0065289 A1 3/2008 Bertosa et al.
2008/0125911 A1 5/2008 Ebrom et al.
2008/0158172 A1 7/2008 Hotelling et al.
2008/0164224 A1 7/2008 McCoy et al.
2008/0164225 A1 7/2008 McCoy
2008/0164226 A1 7/2008 McCoy et al.
2008/0164227 A1 7/2008 LeClear et al.
2008/0164796 A1 7/2008 McCoy et al.
2008/0165282 A1 7/2008 Marcy et al.
2008/0165474 A1 7/2008 McCoy et al.
2008/0165475 A1 7/2008 McCoy et al.
2008/0165476 A1 7/2008 McCoy et al.
2008/0165478 A1 7/2008 McCoy
2008/0165505 A1 7/2008 McCoy et al.
2008/0165509 A1 7/2008 Kendall et al.
2008/0165998 A1 7/2008 LeClear et al.
2008/0166895 A1 7/2008 McCoy et al.
2008/0166915 A1 7/2008 Kendall et al.
2008/0168205 A1 7/2008 McCoy et al.
2008/0192411 A1 8/2008 McCoy
2008/0201032 A1 8/2008 Fayyad et al.
2008/0222327 A1 9/2008 McCoy et al.
2008/0231464 A1 9/2008 Lewis et al.
2008/0231764 A1 9/2008 Kendall et al.
2008/0232053 A1 9/2008 Kendall et al.
2008/0247141 A1 10/2008 Kendall et al.
2008/0265191 A1 * 10/2008 Walborn ..... 251/129.01
2008/0287009 A1 11/2008 McCoy
2009/0009316 A1 1/2009 Kendall et al.
2009/0047824 A1 2/2009 Seibert et al.
2009/0050232 A1 2/2009 Guan et al.
2009/0054804 A1 2/2009 Gharib et al.
2009/0161579 A1 6/2009 Saaranen et al.
2010/0007325 A1 1/2010 Stark
2010/0024573 A1 2/2010 Daverman et al.
2010/0120284 A1 5/2010 Oka et al.
2010/0182753 A1 7/2010 Kendall et al.
2010/0248546 A1 9/2010 McCoy
2010/0281261 A1 11/2010 Razzell
2011/0049308 A1 3/2011 Beaman et al.
2011/0073214 A1 3/2011 Guan et al.
2011/0146328 A1 6/2011 Hendrickson et al.
2011/0146329 A1 6/2011 Kuehl et al.
2011/0146330 A1 6/2011 Kuehl et al.
2011/0146819 A1 6/2011 Hendrickson et al.
2011/0147159 A1 6/2011 Kuehl et al.
2011/0147160 A1 6/2011 Kuehl et al.
2011/0147161 A1 6/2011 Kuehl et al.
2011/0147417 A1 6/2011 Kuehl
2011/0148216 A1 6/2011 McCoy
2011/0148223 A1 6/2011 McCoy
2011/0148649 A1 6/2011 de Cavalcanti et al.
2011/0148650 A1 6/2011 Jenkins et al.
2011/0148651 A1 6/2011 Hendrickson et al.
2011/0149485 A1 6/2011 Kuehl et al.
2011/0152024 A1 6/2011 Kuehl
2011/0153739 A1 6/2011 McCoy
2011/0153821 A1 6/2011 McCoy
2011/0153871 A1 6/2011 Ferragut, II et al.
2011/0153880 A1 6/2011 McCoy

FOREIGN PATENT DOCUMENTS

JP 06310202 A 11/1994
JP 06310204 A 11/1994
JP 06333633 A 12/1994
JP 2007080584 A 3/2007
WO 2007/015274 A1 2/2007

* cited by examiner

PROXIMITY SENSOR ENABLED SUBSTANCE COMMUNICATION COUPLING SYSTEM

BACKGROUND

Appliances and other useful household equipment are increasingly designed to interact with one another, as well as with a variety of accessory devices. An accessory device may be used, for example, in conjunction with an appliance to enhance or supplement the functionality of the appliance.

BRIEF SUMMARY

The invention relates to substance communication couplings for selectively transferring a substance between substance communication coupling components, for example in connecting an accessory device to a host.

According to one aspect of the invention, a substance communication coupling system comprises a first substance communication coupling component capable of being associated with a substance consumer, a contactless proximity target associated with at least one of the first substance communication coupling component and the substance consumer, a second substance communication coupling component operably engageable with the first substance communication coupling component, the second substance communication coupling component capable of being associated with a substance source, a contactless proximity sensor associated with at least one of the second substance communication coupling component and the substance source, a substance pathway between the first and second substance communication coupling components when the first and second substance communication coupling components are interengaged, the substance pathway capable of passing a substance between the first and second substance communication coupling components, and a substance switch operably associated with the contactless proximity sensor to selectively permit the flow of the substance along the substance pathway when the contactless proximity sensor detects the contactless proximity target.

According to another aspect of the invention, a substance communication coupling system connects a portable device having a contactless proximity target to a host and a substance source capable of supplying a substance. The substance communication coupling system comprises a substance communication coupling component, a contactless proximity sensor capable of detecting the contactless proximity target, a substance pathway interconnecting the substance source and the substance communication coupling component, and a substance switch selectively permitting the flow of the substance along the substance pathway in response to detection of a contactless proximity target by the contactless proximity sensor.

According to yet another aspect of the invention, an accessory has a first substance consumer for use in association with a host having a second substance consumer, a first substance communication coupling component, and a substance conduit selectively providing a substance to the first substance communication coupling component in response to a contactless proximity sensor detecting a contactless proximity target. The accessory comprises a second substance communication coupling component, a substance pathway for interconnecting the first substance consumer and the second substance communication coupling component, and a contactless proximity target capable of activating the contactless proximity sensor to activate a substance switch.

According to still another aspect of the invention, an adapter removably couples a portable device having a first device substance communication coupling component to a host having a substance provider, a first host substance communication coupling component, a substance pathway selectively providing a substance to the first substance communication coupling component, and a substance switch selectively activated in response to a contactless proximity sensor detecting a contactless proximity target to permit the substance pathway to provide the substance the first substance communication coupling component. The adapter comprises a second host substance communication coupling component engageable with the first host substance communication coupling component, a second device substance communication coupling component engageable with the first device substance communication coupling component, a substance pathway interconnecting the second host substance communication coupling component and the second device substance communication coupling component for the transfer of a substance there along, and a contactless proximity target capable of activating the contactless proximity sensor to activate the substance switch.

According to still another aspect of the invention, a second substance communicating device communicates with a first substance communicating device having a first substance communication coupling component and a first contactless proximity system component. The second substance communicating device comprises a second substance communication coupling component capable of coupling with the first substance communication coupling component for communication of substance therebetween, and a second contactless proximity system component associated with the second substance communication coupling component and capable of engaging the first contactless proximity system component within a contactless proximity system to selectively regulate the communication of substance between the first and second substance communication coupling components in response to the interaction of the first and second substance communicating devices.

DETAILED DESCRIPTION

Figure 1:
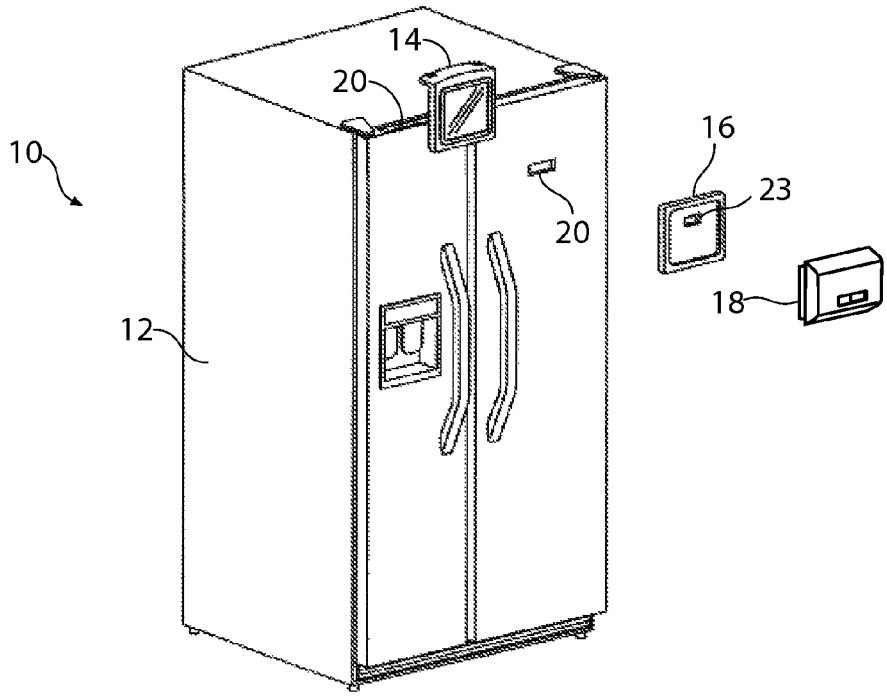
FIG. 1 is a perspective view of a modular system according to a first embodiment of the invention employing a proximity sensor enabled substance communication coupling system for connecting an accessory device to a host.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or to otherwise limit or restrict the claims to the precise forms and configurations shown in the drawings and disclosed in the following detailed description.

The drawings and the following detailed description relate generally to systems of substance communication coupling systems for coupling a substance provider with a substance consumer. The following definitions apply to terms that may be used in the specification and the claims, unless otherwise noted.

As used herein, a "substance" is a material that may be communicated from one device to another. A substance may include a gas, a liquid, or a solid, or any combination thereof. Examples of substances include, but are not limited to, liquid soap, powdered soap, compressed air, tablets, caplets, water, ice cubes, and a beverage.

As used herein, "substance communication" or a "substance communication service" is a useful provision of a substance from one device to another device. Communicating a substance includes supplying or receiving a substance. As used herein, communication of substance includes both unidirectional and multi-directional communication between any two devices, either directly or through an adapter, as defined herein. Substance communication may be provided in quanta, such as capsules or other doses of substances, batches of discrete items such as tablets, or consumable components.

The terms "provide" and "supply" and any variation thereof, are used herein to denote a source of the substance relative to a device receiving the substance. Neither term is limited to the original source of the substance. A device that provides or supplies the substance may simply be passing on the substance from the original source. For example, a device that provides water may pass on water it receives from a residential water supply. However, the device may alternatively or additionally provide another substance that originates with the device, such as an additive stored in a reservoir.

The term "receive" and any variation thereof, is used herein to denote receipt of the substance relative to the device providing the substance. The term is not limited to the ultimate consumer of the substance. A device that receives a substance may simply be passing on the substance from the source, such as an appliance, to a device that will consume, as hereinafter defined, the substance. The device which receives a substance is not necessarily the end consumer of the substance.

The term "consume" and any variation thereof, as used herein, denotes the act of employing or dispensing at least a portion of the substance received in connection with performing a function.

The term "consumable" and any variation thereof, as used herein, includes any substance that may be consumed by a host, an accessory device, or a user person, such as food, cosmetics, or medicine. The consumable may, for example, be a substance that is used up and must be replenished for subsequent cycles of operation. For a clothes washer, the consumable might be a detergent and/or a softener. For a clothes dryer, the consumable might be an anti-static cloth. For a cooking or refrigeration appliance, the consumable may actually be the article on which the appliance performs its cycle of operation, as in the case of food, later to be consumed by a person. More specific examples of the use of a consumable in appliances include dispensing additives for clothes washers, clothes dryers, or combination washer/dryer appliances. The additives can include, but are not limited to, normal detergents, gentle detergents, dark clothing detergents, cold water detergents, fabric softeners, chlorine bleaches, color-safe bleaches, and fabric enhancement chemistry. Non-limiting examples of fabric enhancers are additives to provide stain resistance, wrinkle resistance, water repellency, insect repellency, color fastness, fragrances, and anti-microbials. Another example of a consumable is the filters used by an appliance. Refrigerators, dryers, washers, and dishwashers are all known to use filters that are consumed in the sense that they wear out and must be replaced.

The term "coupled" and any variation thereof, as used herein, includes any type of connection that permits transfer of a substance between two devices. The term "coupled" does not require a physical connection between the two devices, so long as the coupling permits transfer of a substance. The term "coupled" includes both fixed and removable coupling, as well as both continuous and intermittent coupling.

A "service connector system" is a connector system having at least two separate service connector components, also referred to as service couplers, each associated with a useful device. The service connector components cooperate with one another to couple the useful devices to facilitate communication of a service between the useful devices. A service connector system may carry multiple services. An electromagnetic service connector system, for example, may be associated with or incorporated into a substance connector system or may be independent of a substance connector system but be associated with the same substance holder, substance provider or substance consumer.

The term "useful device" and any variation thereof, as used herein, is a device that is capable of performing a useful physical or virtual function either alone or in combination with another device.

The term "substance consumer" and any variation thereof, as used herein, is any useful device that employs, uses, stores, or dispenses a substance in connection with performing a physical or virtual function. A substance consumer may be, for example, a smart utensil, an appliance, a resource controller, such as a water controller, a dispenser, a filter, a water filter, an air filter, a detergent dispenser, a drink dispenser, a detergent cartridge, and a substance holder, such as a bottle, a jug, or a cycle accessory.

The term "substance provider" and any variation thereof, as used herein, is any device that is capable of providing or supplying a substance to another device.

A "substance communicating device" is any substance holder, substance provider or substance consumer that is capable of communicating substance with another device.

A "substance communicating system" is any combination of substance communicating devices capable of communicating a substance therebetween.

As used herein, the term "substance holder" is anything that holds or contains a substance, which may include, but is not limited to, a container, a dispenser, a cartridge, a dish, a bag, or a carton.

As used herein, the term "consumable holder" is any substance holder that holds or contains a consumable.

As used herein, the term "host" is an apparatus that has a primary function independent of providing or receiving a substance. A host may be a substance provider, a substance consumer, or both. For example, the host may be an appliance and the primary function can be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host may alternatively comprise a structural feature of a building, such as a wall, a cabinet, or a door. The host may also provide other services, such as electrical power, electronic data, mechanical power, illumination, heat, or sound.

As used herein, the terms "accessory" or an "accessory device" refer to any useful device which may be coupled to a host and communicate a substance to or from the host. An accessory device may be used primarily in conjunction with a host to enhance, supplement, regulate, or monitor the functionality of the host or may have independent functionality and utility. An accessory device may be a substance provider, a substance consumer, or both. An accessory device may be a substance holder or a consumable holder. Examples of an accessory device include, but are not limited to, a paper product dispenser, a dry goods dispenser, a bottle opener, a liquid dispenser, a pill dispenser, a water dispenser, a fan, a motor, a tissue dispenser, a can opener, a mixer, a blender, an ice dispenser, an ice maker, an ice cream maker, a coffee maker, a soap dispenser, and a softener dispenser. An accessory or accessory device may also communicate electromagnetic service with the host.

As used herein, the term "portable device" is an accessory device that is designed to be moveable by a user during its useful life between a use location and a storage location or alternative use location.

As used herein, the term "independent device" is a useful device that provides a useful function without being connected to a substance provider. In some cases the primary function of the independent device is different from the primary function of a host from which the independent device may receive a substance. The independent device may be an accessory device.

As used herein, the term "dependent device" is a useful device that provides a useful function only when connected to a substance provider. A dependent device may be a substance consumer. Examples of a dependent device that may be coupled to a host include, but are not limited to, a smart pan or pot, an ice maker, and a bulk detergent dispenser.

As used herein, the term "substance communication coupling system" or "substance connector system" refers to any connector system having at least two separate substance communicating connector components, each of which is associated with a useful device. The substance communicating connector components cooperate with one another to couple the useful devices to facilitate communication of a substance between the useful devices.

As used herein, the term "switched substance communication coupling system" is a substance communication coupling system having switching or valving capability in at least one of the substance communicating connector components operable to selectively control the communication of a substance between the components of the substance communication coupling system.

As used herein, the term "substance switch" is any component used to selectively regulate the communication of a substance between components of a substance communication coupling system, such as switches, valves, pumps, fans, and controllers for controlling such devices. A substance switch may be associated with more than one type of service. For example, a substance switch may be associated with, integrated with, or comprise an electromagnetic switch or may be independent of the electromagnetic switch.

As used herein, the term "switching valve" is any valve used to selectively facilitate the communication of a substance between components of a substance communication coupling system.

"Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

A "proximity target" as used herein is any component or device that may be detected when positioned within a predetermined distance of an associated proximity sensor, defined below. A proximity target may be passive, such as a visual target or a magnetic target formed of magnetic or magnetic responsive material. Other examples of passive proximity targets may include a conductive component or surface capable of cooperating with a magnetic field, a current, or a voltage provided by a proximity sensor. A proximity target may alternatively be active or powered such as an electromagnet, a generator of a magnetic field, a current, a voltage or an acoustic wave. An active proximity target may alternatively provide a powered readable display or dispense a detectable chemical.

A "proximity sensor" as used herein is any component or device that may detect an associated proximity target when the proximity target is within a predetermined distance of the proximity sensor. A proximity sensor may detect, for example, a change in an electromagnetic field, an electromagnetic wave, an acoustic wave, a visual target, a chemical component, an electrical signal, a change in voltage, a change in current, a change in frequency, a change in resistance, a change in inductance, a change in capacitance, a mechanical signal, a change in pressure, a displacement, a vibration, and the presence of a chemical. A proximity sensor may be active or passive, such as a magnetic sensor of magnetic or magnet responsive material, or may alternatively be active. Examples of active sensors include active magnetic sensors, light sensors, optical sensors, acoustic sensors, electromagnetic sensors, chemical sensors and thermal sensors. Examples of magnetic sensors include magnets and magnetic responsive components. Examples of optical sensors include infrared sensors, photoelectric sensors, fiber optic sensors, photo resistors, photovoltaic sensors, photo diodes and cameras. Examples of electromagnetic sensors include radio receivers, radar sensors, Hall Effect sensors, inductive sensors, capacitive sensors, variable reluctance sensors and eddy current sensors. Examples of acoustic sensors include ultrasonic sensors and microphones. A contact proximity sensor detects a proximity target by touching the proximity target. A contactless proximity sensor detects the proximity target through a wireless or contactless means. For example, magnetic flux can be used as the signaling mechanism between a contactless proximity sensor and a contactless proximity target.

As used herein, the term "proximity system" is a system that uses a "proximity switch" operated by a plurality of "proximity coupling components," each associated with a different parent device, for determining that the parent devices are in proximity with each other. Parent devices are usually paired, examples of which include a service provide and a service consumer, a host and an accessory device, and a host and an adapter. Proximity coupling components may include a proximity target associated with one parent device to actively or passively provide an indication of the presence of the one parent device and a proximity sensor associated with the other parent device that is responsive to the presence of the proximity target to activate the proximity switch. The proximity switch may be used to provide a signal or message indicative of the proximity of two parent devices or may directly or indirectly regulate the flow of a service along a service line. The systems disclosed herein employ contactless proximity systems, wherein the proximity target and proximity switch use contactless or wireless means to detect the proximity of the two parent devices.

As used herein, the term "plug" is a generally male substance connection component.

As used herein, the term "receptacle" is a generally female substance connection component.

As used herein, the terms "substance line" or "substance pathway" refer to a pathway for transferring a substance from one location to another. The substance line may have any of a variety of configurations depending on the type of substance being transferred, including, but not limited to, a pipe, a conduit, a tube, a channel, or fludically-aligned supply and receiver ports with a gap therebetween. It will be appreciated that the substance line or pathway may comprise a gap across which the substance is directed by gravity, magnetism, electrical induction, heat radiation or other field.

As used herein, the term "adapter" is an intermediate device that may be provided between a first and second useful device, such as between a host and an accessory, to facilitate the communication of substances between the first and second useful devices. An adapter may receive a substance from the first useful device and provide the substance or a modified version of the substance to the second useful device, for example, by providing a substance dispensing through a metering process, by processing the substance, or by combining the substance with an additive. In some applications, multiple adapters may be interposed between two useful devices. In other applications, three or more useful devices may be coupled to a single adapter, such as multiple accessories for a host. In some applications, the adapter may itself be a useful device providing a useful function not provided by the other useful device or devices coupled to it. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

As used herein, the term "functional unit" is the combination of any adapter coupled to an accessory, which together provide functionality that neither the adapter nor the accessory can alone provide. Any functional unit itself is also included within the meaning of the term "useful device". In some cases, it is contemplated that a dependent device may be coupled with an adapter that provides one or more services required by the dependent device to enable the functional unit to provide a useful function, in which case the functional unit also constitutes an independent device.

Figure 2:
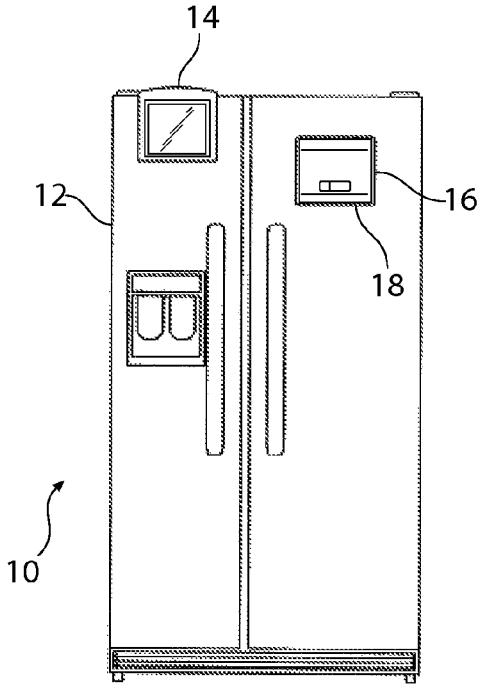
FIG. 2 is a front elevational view of the modular system of FIG. 1 showing the accessory device attached to the host.
Figure 3:
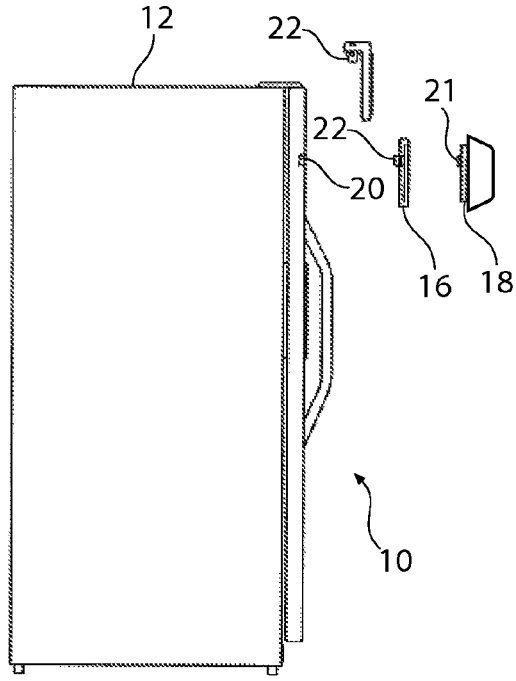
FIG. 3 is a side elevational view of the modular system of FIG. 1 showing the accessory device removed from the host.

Referring to FIGS. 1 through 3, a schematic illustration of a modular system 10 according to a first embodiment of the invention is shown to include at least one host 12 and at least one accessory device 14 that can be coupled to host 12. Both the host 12 and the accessory device 14 are substance communicating devices, and the host 12 may be a substance provider, and the accessory device 14 may be a substance consumer.

Accessory device 14 may be either directly or indirectly coupled to host 12. Direct coupling occurs when accessory device 14 includes a substance communication coupling system suitably configured for engaging a corresponding substance communication coupling system of host 12 to establish a pathway for transferring a substance between the host 12 and the accessory device 14. The substance pathway provides a line for transferring at least one substance from host 12 to accessory device 14 and from accessory device 14 to host 12.

An adapter 16 can be provided for coupling a second accessory device 18 having an incompatible substance communication coupling system to host 12. A substance communication coupling system is incompatible if it cannot be directly coupled to a corresponding substance communication coupling system, such as when the incompatible substance communication coupling system lacks certain physical features that would enable the substance communication coupling system to engage the corresponding coupling system to establish a substance pathway. Adapter 16 may include a substance communication coupling system that can be directly coupled with the substance communication coupling system of host 12 and a second substance communication coupling system that can be directly coupled with the incompatible substance communication coupling system of accessory device 18, thereby establishing a substance pathway between host 12 and accessory device 18.

Although accessory device 14 is shown coupled to an upper surface of host 12, whereas accessory device 18 is shown attached to a front surface of host 12 by way of adapter 16, it shall be appreciated that in practice, accessory device 14 and adapter 16 may be suitably configured for coupling to host 12 in any desired location and manner in order to accommodate the design and performance requirements of a particular application. For example, accessory device 14 and adapter 16 may be configured to attach to an inside wall of a food compartment of a consumer appliance, such as a refrigerator or oven, or to an inside surface of a laundry compartment of a washer or dryer.

Host 12 may perform a primary function. As illustrated herein, host 12 is a refrigerator performing a cooling cycle and/or an ice making cycle. Although the figures show an appliance comprising a refrigerator, it shall be understood that the invention is not limited to refrigerators or appliances in general.

Accessory devices 14 and 18 may also perform at least one primary function. The primary functions of accessory devices 14 and 18 can be different from the primary function performed by host 12, although they need not be.

Host 12 can be configured to provide or receive at least one substance to or from accessory devices 14 and 18. Similarly, accessory devices 14 and 18 may also be configured to provide or receive at least one substance to or from host 12. It is not necessary that the substance transferred between host 12 and accessory devices 14 and 18 be used in performing the primary function of host 12 or accessory devices 14 and 18, or otherwise be related to the primary function of either accessory device.

As mentioned previously, in instances where the accessory device includes an incompatible substance communication coupling system that prevents direct coupling of the consumer accessory to host 12, adapter 16 may be provided for indirectly coupling the accessory device to host 12. Adapter 16 operates to establish a substance pathway for transferring the desired substance between host 12 and accessory device 18 having the incompatible substance communication coupling system.

At least one substance can be supplied to accessory devices 14 and 18 from host 12, or from accessory devices 14 and 18 to host 12. The supply of the substance can be uni-directional in that either host 12 supplies the substance to accessory devices 14 and 18 or accessory devices 14 and 18 supply the substance to host 12. The supply of the substance can also be bi-directional in that the supplied substance can be delivered from host 12 to accessory devices 14 and 18 and from accessory devices 14 and 18 to host 12.

Substance communication between host 12 and accessory devices 14 and 18 may include liquid communication, gaseous communication, and/or solid communication, among others. Liquid communication may include the transfer of a liquid, such as water, hydraulic fluid, or cooling fluid, among others, between host 12 and accessory devices 14 and 18. Gaseous communication is similar to liquid communication, except the medium by which the substance is transferred is a gas rather than a liquid. For example, host 12 may provide a supply of pressurized air to accessory devices 14 and 18. Solid communication may include the transfer a solid material, such as a powder, tablets, or pellets, to name a few. It shall be appreciated that these are only a few examples of the various types of substances that can be transferred between host 12 and accessory devices 14 and 18.

As illustrated, accessory device 18 is a medicine module. The module may provide convenient access and consumer visibility to a supply of medicine for a consumer and allow control of temperature and humidity independently of the host 12 by the use of a secondary coolant communicated from the host 12, or alternatively by treated air supplied by the host 12.

It will further be appreciated that, while the embodiments in the drawings illustrate specific types of substance communicating devices, such as a host 12 that may operate and a substance provider, an accessory device 14 that may operate as a substance consumer, and an adapter 16 that may act as a conduit for the transfer of substance from host 12 to accessory device 18, variations from this configuration are possible. These variations include systems with only two electromagnetic service communicating devices, systems with more than three substance communicating devices, systems where any of the devices may be substance consumers and/or substance providers, systems where multiple services are communicated and systems where services are received by one device, converted in some manner, and then passed to a third device. Furthermore, in the following description, certain components of connector systems and proximity systems are described for the illustrative purposes as being associated with specific substance communicating devices. For example, a proximity switch, target or sensor may be described as being located in a substance provider, substance consumer, host or portable device. It will be appreciated that these system components may be alternatively assigned to the various substance communicating devices depending on the application.

Host 12 and accessory device 14, may each comprise at least one substance communication coupling system component, respectively referred to herein as a host substance communication coupling component 20 and an accessory substance communication coupling component 22.

Host substance communication coupling component 20 and accessory substance communication coupling component 22 have complementary configurations that enable the substance communication coupling components to be coupled to one another, thereby establishing a substance pathway over which desired substances can be transferred between host 12 and accessory device 14.

Host 12 also has a second host substance communication coupling component 20 provided on its front surface for the adapter 16. In instances where accessory device 18 includes an incompatible substance communication coupling component, and the adapter 16 is used as an intermediate component to connect accessory device 18 to host 12, then adapter 16 will have a second device substance communication coupling component 23 for engagement with a device substance communication coupling component 21 of accessory device 18 as well as host substance communication coupling component 22 for connection with the host substance communication coupling component 20 of the host 12. Therefore, accessory substance communication coupling component 22 may have the same general configuration whether included as part of accessory device 14 or adapter 16, and host substance communication coupling component 20 may have the same general configuration whether it couples directly with an accessory device or an adapter. Accordingly, for purposes of discussion, the various features and operation of substance communication coupling component 22 will hereinafter be described in connection with accessory device 14, but it shall be appreciated that exemplary accessory substance communication coupling component 22 may also be used in conjunction with adapter 16.

Figure 4:
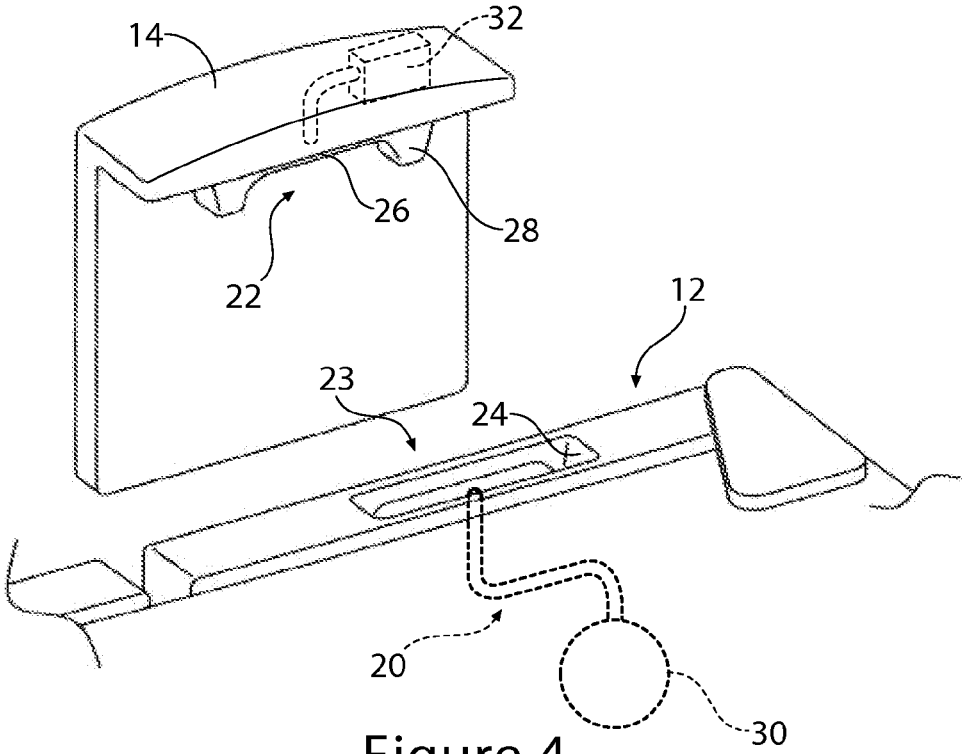
FIG. 4 is a partial top rear perspective view of the modular system of FIG. 1 with the accessory device removed from the host, showing a host portion of the proximity sensor enabled substance communication coupling system.
Figure 5:
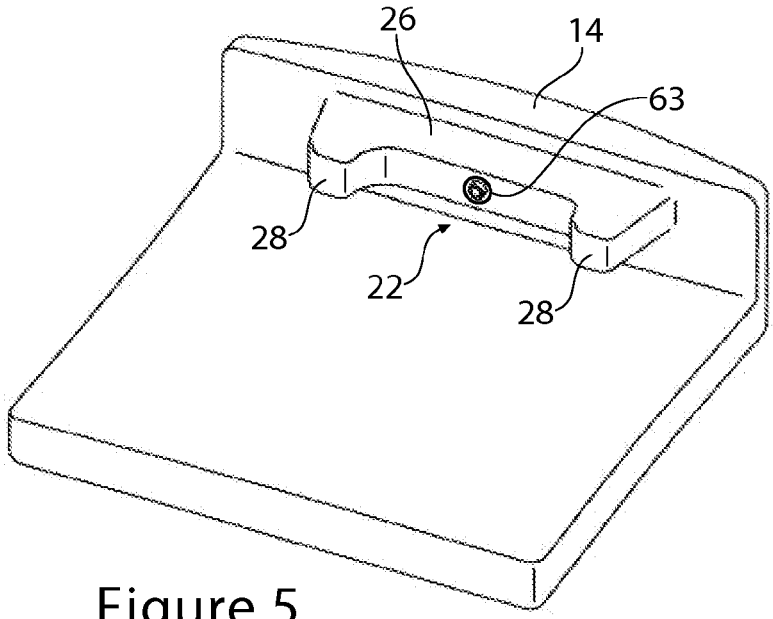
FIG. 5 is a bottom perspective view of the accessory device of FIG. 1 showing an accessory device portion of the proximity sensor enabled substance communication coupling system.

Referring to FIGS. 4 and 5, host substance communication coupling component 20 can be integrally formed with host 12 or may be an add-on device. For purposes of discussion, host substance communication coupling component 20 is shown integrally formed with host 12. When configured as an add-on device, host substance communication coupling component 20 may also function as an adapter to enable a host and an accessory device having dissimilar substance communication coupling components to be indirectly coupled to one another. Host substance communication coupling component 20 may be removable or non-removable from host 12. Host substance communication coupling component 20 can be configured to transfer or receive a single substance or multiple substances.

Similarly, accessory substance communication coupling component 22 may be integrally formed with accessory device 14 or may be an add-on component. For purposes of discussion, accessory substance communication coupling component 22 is shown integrally formed with accessory device 14. When configured as an add-on component, accessory substance communication coupling component 22 may also function as an adapter to enable a host and an accessory device having dissimilar substance communication coupling components to be indirectly coupled to one another. Accessory substance communication coupling component 22 may be removable or non-removable from accessory device 14. Accessory substance communication coupling component 22 can be configured to transfer or receive a single substance or multiple substances.

The host substance communication coupling component 20 may be provided with a receptacle 23, including a recess 24, proportioned to accept a plug 26 extending from the accessory substance communication coupling component 22. Plug 26 may be provided with ridges 28 to facilitate alignment of the substance communication coupling components. It will be appreciated that host substance communication coupling component 20 and accessory substance communication coupling component 22 may include various features to facilitate coupling of accessory device 14 to host 12. For example, ridges 28 are merely one example of the type of features that may be incorporated into host substance communication coupling component 20 and accessory substance communication coupling component 22 to aide alignment and coupling of accessory device 14 to host 12. In practice, other configurations may also be employed to accommodate various design considerations of a particular application.

Figure 6:
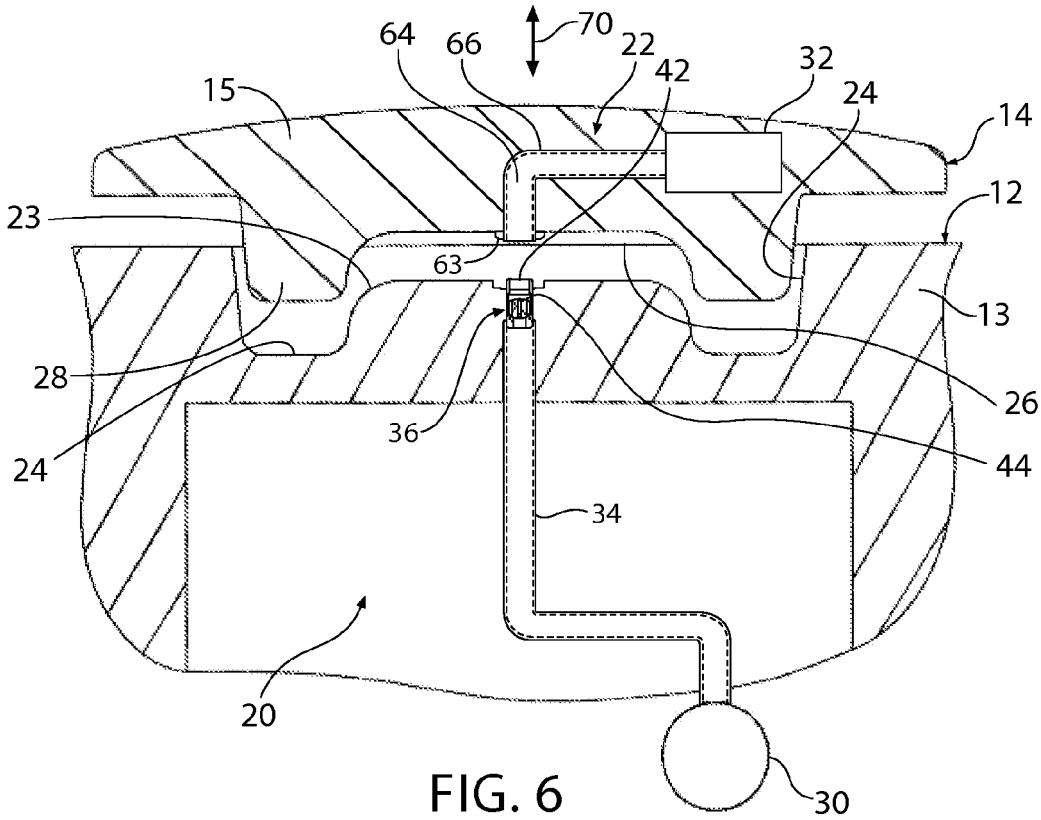
FIG. 6 is a partial cross-sectional view of the proximity sensor enabled substance communication coupling system of FIG. 1 using a magnetic proximity target and a magnetic proximity sensor, shown with the accessory device portion of the substance communication coupling system positioned for engagement with the host portion of the substance communication coupling system.
Figure 7:
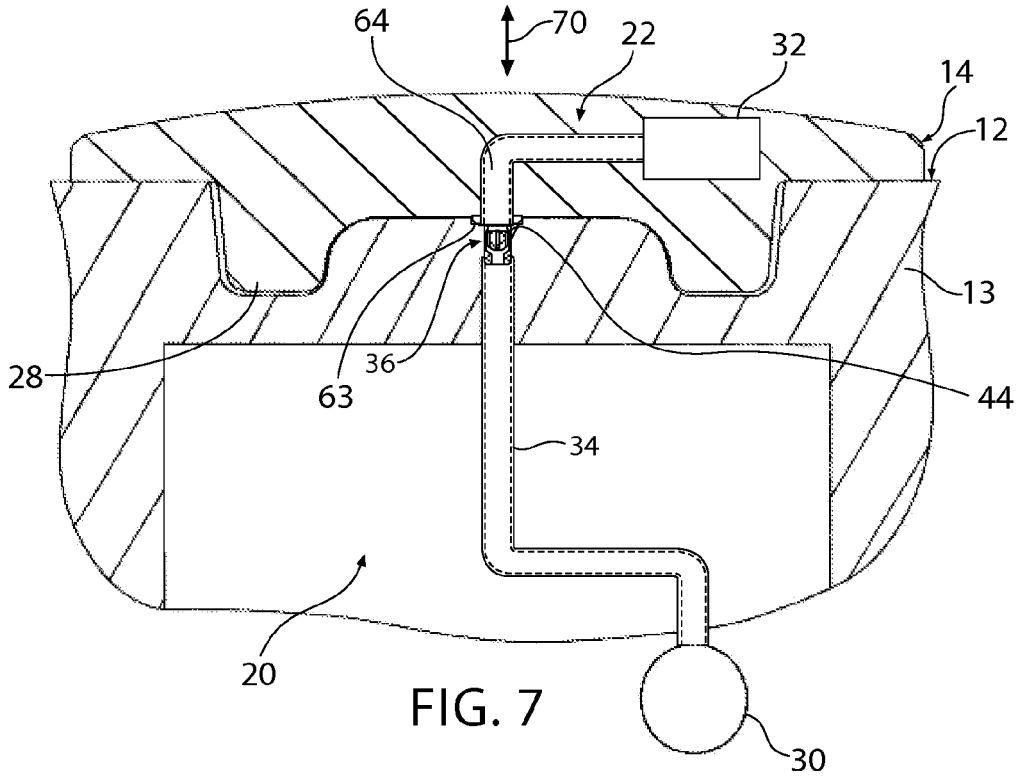
FIG. 7 is a partial cross-sectional view similar to FIG. 6 showing the accessory device portion of the substance communication coupling system engaged with the host portion of the substance communication coupling system.

Referring to FIGS. 6 and 7, host 12 may be provided with a substance provider 30 to selectively provide a substance to the host substance communication coupling component 20 for delivery to the accessory substance communication coupling component 22. The accessory device 14 may similarly be provided with a substance consumer 32 capable of using the substance delivered to the accessory substance communication coupling component 22. The various coupling system features shown in these figures are illustrative of configurations for selectively facilitating the provision of substance from the substance provider 30 to the substance consumer 32.

Substance provider 30 may be connected by way of an internal substance line 34 to substance flow regulating device or substance switch 36 that extends through a housing 13 of the host 12. It should be understood that various substance switches may be used to control substance flow through substance line 34, such as a valve, a pump, or a fan. The type of substance switch may be designed to fail in a non-flowing condition, such as a normally closed valve requiring power to open.

It should be noted that housing 13 may be an integral part of host 12 or may be a separate component. For purposes of discussion, housing 13 is illustrated as an integral part of host 12.

For purposes of discussion, substance line 34 is illustrated generically as a tube-like structure. The generically illustrated configuration is not intended to depict any particular configuration, but rather schematically represents a variety of potentially different configurations. In practice, the actual configuration may vary depending on, at least in part, the type of substance being transferred, packaging requirements, and manufacturing considerations, to name a few. For example, a substance line for transporting a high pressure fluid or gas may have a different configuration than a substance line for transporting a powder, due at least in part to the higher operating pressure loads that may be imposed on the fluid substance line as opposed to the powder substance line. Thus, it shall be appreciated that substance line 34 may include other configurations to accommodate various design considerations, including but not limited to, the type of substance being provided.

Figure 6A:
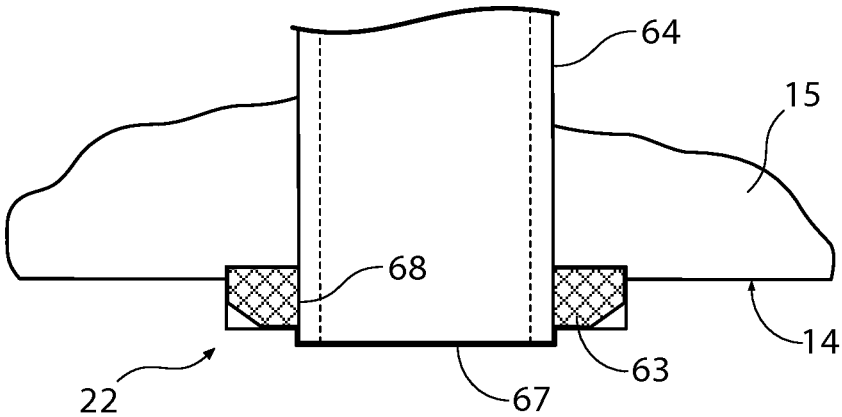
FIG. 6A is an enlarged cross-sectional view of a portion of a proximity switched valve employed with the sensor enabled substance communication coupling system of FIG. 6 shown in a closed position.
Figure 6A:
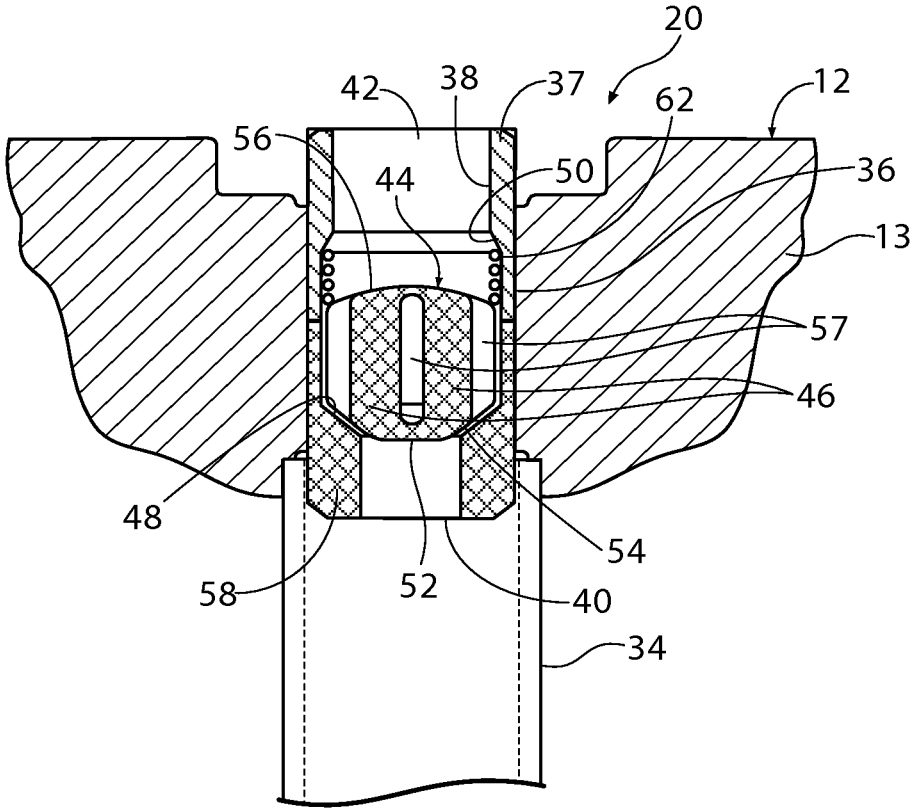
Figure 7A:
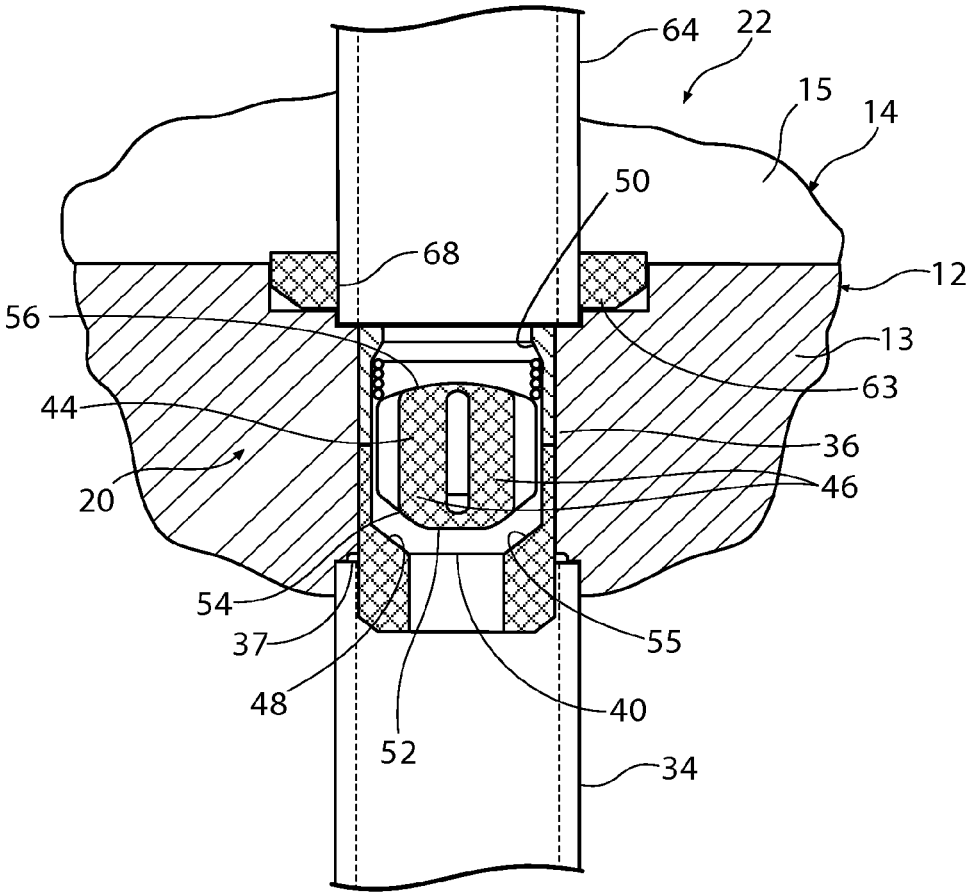
FIG. 7A is an enlarged cross-sectional view of a portion of the proximity switched valve employed with the sensor enabled substance communication coupling system of FIG. 7 shown in an open position.

Referring to FIGS. 6A and 7A, substance switch 36 may include a valve body 37 that includes a substance pathway 38 extending through the valve body. An inlet port 40 of substance pathway 38 may be attached to substance line 34 and an opposing exit port 42 is accessible from outside of housing 13.

Substance switch 36 may further include a piston 44 slidably disposed within substance pathway 38. Piston 44 is moveable between a closed position, as shown in FIG. 6A, and an open position, as shown in FIG. 7A. Piston 44 may include internal pathways 57 and one or more scalloped regions 46 open to pathways 57 for allowing a substance to flow past piston 44 when the substance switch 36 is in the open position. Substance switch 36 is movable between the closed position and the open position to enable a substance to be transferred between host 12 and accessory device 14 when accessory device 14 is coupled to host 12. Substance switch 36 is generally disposed in the closed position when accessory device 14 is decoupled from host 12.

The range of travel of piston 44 within substance pathway 38 can be controlled by trapping the piston between a first shoulder 48 and a second shoulder 50, which act as stops to prevent piston 44 from traveling beyond the shoulders 48 and 50. The distance between the shoulders 48 and 50 defines the range of travel of piston 44. Substance pathway 38 has a smaller diameter in the region of shoulders 48 and 50 than an outer diameter of piston 44, thereby preventing the piston 44 from traveling beyond either shoulder 48 or 50.

An end 52 of piston 44 may include a conical surface 54 that engages a correspondingly shaped mating surface 55 (See FIG. 7A) of shoulder 48 when the piston is arranged in the closed position (see FIG. 6A). Piston 44 substantially blocks the transport of a substance past the piston when arranged in the closed position.

An end 56 of piston 44 opposite end 52 can engage or be movable toward second shoulder 50 when the piston is arranged in the open position, as shown in FIG. 7A. Scalloped regions 46 of piston 44 may be configured to provide one or more end regions that may engage second shoulder 50. The inner diameter of second shoulder 50 may be larger than a minimum root diameter of the scalloped region of piston 44, thereby providing a pathway through which the substance may travel to exit port 42 from inlet port 40 of valve body 37 when the piston is positioned in the open position.

As can be observed from FIGS. 6A and 7A, scalloped region 46 has a generally uniform depth. Such an arrangement may be simpler and less costly to manufacture than other more complex configurations. Providing the scalloped region with a generally constant uniform depth, will generally require that first shoulder 48 have a smaller inner diameter than second shoulder 50. This arrangement allows conical surface 54 of piston 44, which generally extends inboard of the scallops 46, to engage surface 55 of first shoulder 48, while also providing a flow path past second shoulder 50 when piston 44 is arranged in the open position. It shall be appreciated, however, that this is merely one possible scalloped configuration, and that there are a variety of other arrangements that may also be utilized, depending on a variety of factors, such as manufacturing requirements, cost, performance considerations, as well as others. For example, scallops 46 may be tapered inward from end 52 of piston 44 to end 56. Such a configuration may allow first and second shoulders 48 and 50 to have the same inner diameter, which may improve the manufacturability of the valve body 37.

Piston 44 may be biased toward the closed position as shown in FIG. 6A. This may be accomplished by forming at least a portion of piston 44 from a magnetized material, and forming an end region 58 of valve body 37 located in the region of first shoulder 48 from a magnetic material, such as steel. The magnetized material in piston 44 will tend to be attracted toward shoulder 48, thereby biasing the piston to the closed position. This is merely one possible configuration, and it shall be appreciated that other configurations may also be utilized depending on the requirement of the particular application. For example, end region 58 and piston 44 may both be formed from a magnetized material. In this configuration, the poles of the magnetized material in the piston and the valve body are arranged in such a manner that piston 44 is attracted toward first shoulder 48 of valve body 37. Additionally, end region 58 may be formed of a magnetized material, whereas at least a portion of piston 44 may be formed of a magnetic material, such as steel. Further, a biasing member 62, such as a coil spring, may be disposed within substance pathway 38 between second shoulder 50 and piston 44. Biasing member 62 urges piston 44 into the closed position. Biasing member 62 may be used in addition to the previously described magnetic biasing mechanisms, or by itself. It shall be appreciated that these are only a few of the various biasing mechanisms that may be employed for urging piston 44 into the closed position. Other biasing mechanisms may also be employed depending on, at least in part, the design parameters of the particular application.

Referring to FIGS. 6 and 6A, accessory device 14 may include a proximity target, such as a magnetic member 63. An accessory substance line 64 may extend from the substance consumer 32 through a passageway 66 formed in a housing 15 of accessory device 14, and an aperture 68 passing through the magnetic member 63. An end 67 of accessory substance line 64 extends out of the plug 26 to a location engageable with the exposed end of valve body 37 of substance switch 36. It should be noted that housing 15 may be an integral part of accessory device 14 or may be a separate component. For purposes of discussion, housing 15 is illustrated as an integral part of accessory device 14. Operation of substance switch 36 can be controlled by the action of the magnetic member 63 in a manner described below.

Similar to substance line 34, accessory substance line 64 is also illustrated generically as a tube-like structure, and is not intended to depict any particular configuration. In practice, accessory substance line 64 may have a variety of potentially different configurations depending on the type of substance being transferred, as well as other design considerations.

Referring to FIGS. 6 and 7, the process of coupling and decoupling accessory device 14 with host 12 will now be described. Coupling of accessory device 14 to host 12 can be accomplished by positioning accessory device 14 adjacent host 12 in such a manner that accessory substance communication coupling component 22 is generally aligned with host substance communication coupling component 20, as shown in FIG. 6. Accessory substance communication coupling component 22 and host substance communication coupling component 20 can be coupled by generally moving accessory device 14 toward host 12 along a path indicated by arrow 70 until the two members are fully seated, as shown in FIG. 7. Ridges 28 on plug 26 are received in recess 24 of receptacle 23 to guide substance communication coupling components 20 and 22 into engagement and bring the exposed end of substance switch 36 of the host 12 into engagement with the exposed end of substance line 64 of accessory device 14.

At least one of the piston 44 and the magnetic member 63 is a magnet while the other may be either formed of a magnetically responsive material or may be a magnet. When substance communication coupling components 20 and 22 are engaged, magnetic member 63 acts as a proximity target for piston 44, which acts as a proximity sensor in a manner described below.

More particularly, in the illustrated structure of FIGS. 6A and 7A, when coupling substance communication coupling components 20 and 22 are spatially disposed, such that the attractive magnetic force between magnetic member 63 and piston 44 overcome the opposing attractive force produced by the magnetic material located in end 58 of valve body 37, piston 44 is displaced toward magnet member 63 and away from first shoulder 48 of valve body 37, thereby opening substance switch 36 and allowing a substance to flow from substance provider 30 of host 12 to substance consumer 32 of accessory device 14, as shown in FIG. 7A. Thus, piston 44 of substance switch 36 acts as a proximity sensor, detecting and reacting to the magnetic member 63, acting as a proximity target, to open the valve and thereby facilitate the flow of substance from substance provider 30 to the substance consumer 32.

Accessory device 14 can be decoupled from host 12 by reversing the previously described process for coupling the two devices. Separation of accessory substance communication coupling component 22 from host substance communication coupling component 20 displaces magnetic member 63 away from piston 44, thereby allowing the magnetized material in end 58 of valve body 37 to return piston 44 to the closed position and into engagement with first shoulder 48 of valve body 37.

Figure 8:
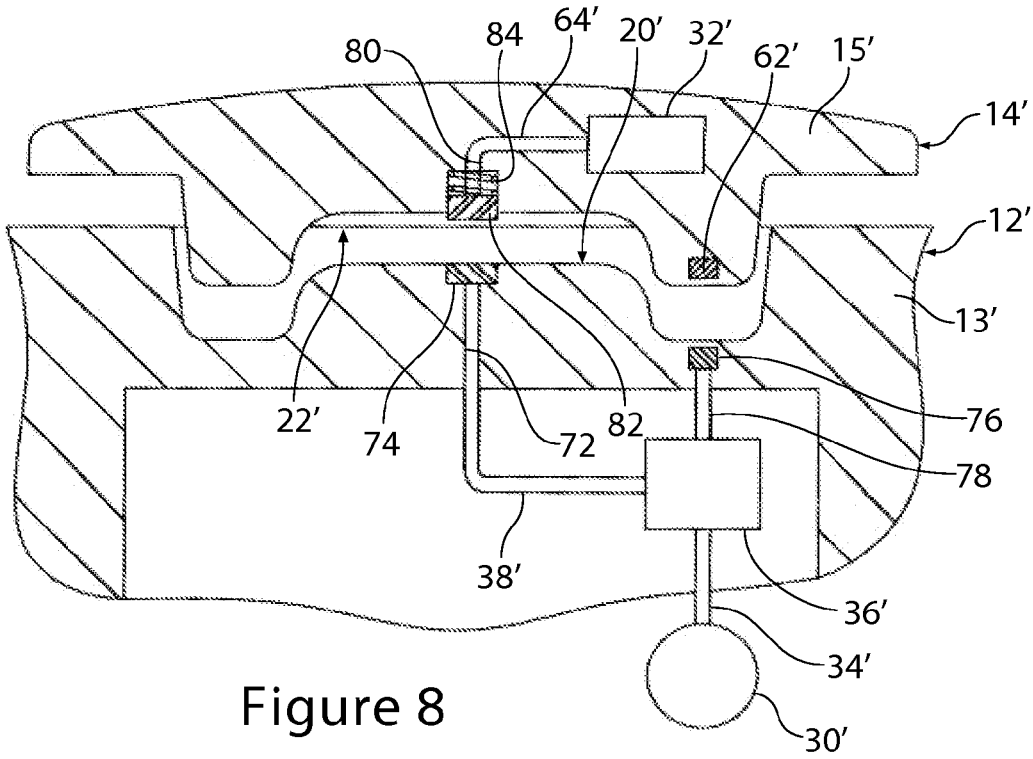
FIG. 8 is a partial cross-sectional view of a modular system according to a second embodiment of the invention employing a proximity sensor enabled substance communication coupling system using an unpowered proximity switched valve, and showing an accessory device portion of the substance communication coupling system positioned for engagement with a host portion of the substance communication coupling system.
Figure 9:
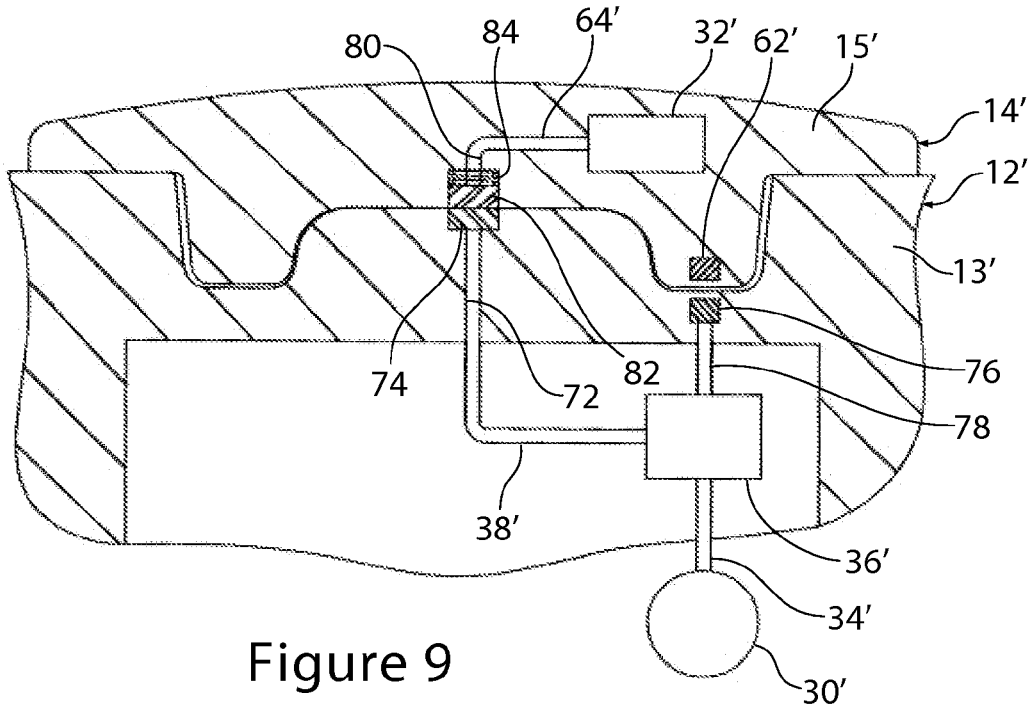
FIG. 9 is a partial cross-sectional view similar to FIG. 8, showing the accessory device portion of the substance communication coupling system engaged with the host portion of the substance communication coupling system.

Referring to FIGS. 8 and 9, a modular system according to a second embodiment of the invention is shown and comprises a host 12' having a substance communication coupling component 20' and an accessory device 14' having a substance communication coupling component 22', where elements in common with the first embodiment are denoted by the same reference numeral bearing a prime (') symbol. The host 12' may include a substance provider 30' connected by a first substance line 34' to a substance switch 36'. A second substance line 38' extends from substance switch 36' through an aperture 72 in the housing 13' to a first interface 74. It will be appreciated that the precise configuration of interface 74 may vary depending, at least in part, on the substance being provided by substance lines 34' and 38'. Substance switch 36' may be associated with a proximity sensor 76 adapted to activate substance switch 36' to selectively permit the flow of a substance from first substance line 34' to second substance line 38' in response to the detection of an appropriate proximity target. The proximity sensor 76 may be configured, for example, to sense a magnetic field, an electromagnetic or acoustic wave, a visual target, a temperature or a chemical. The proximity sensor 76 is connected to substance switch 36' by a line 78 to communicate to substance switch 36' the detection of an appropriate proximity target. The communication along line 78 may be, for example, by means of an electrical signal, an acoustic or electromagnetic wave, or a physical displacement of a linking member.

The accessory device 14' may be provided with a substance consumer 32' connected by a substance line 64' through a passageway 80 in the housing 15' to a second interface 82 engageable with the first interface 74. The accessory device 14' may further be provided with a biasing member, such as a spring 84, for biasing the second interface 82 partially through passageway 80. The accessory device 14' is further provided with a proximity target 62' chosen for cooperation with the proximity sensor 76.

Coupling of accessory device 14' to host 12' can be accomplished by positioning accessory device 14' adjacent host 12' in such a manner that accessory substance communication coupling component 22' is generally aligned with host substance communication coupling component 20', as shown in FIG. 8. With substance communication coupling components 20' and 22' engaged, as shown in FIG. 9, proximity target 62' comes into the range of proximity sensor 76 and activates substance switch 36' to switch on the flow of substance from the substance provider 30' to the substance consumer 32'. The spring 84 limits the movement of the second interface 82 against first interface 74 to facilitate a reliable seal between interfaces 74 and 82. Similarly, detaching accessory substance communication coupling component 22' from host substance communication coupling component 20' displaces proximity target 62' away from the proximity sensor 76 and releases the substance switch 36'. The spring 84 may provide continued engagement of second interface 82 with first interface 74 to accommodate a small amount of relative displacement between substance communication coupling components 20' and 22'.

It should be noted that the proximity sensor 76 and substance switch 36' are either unpowered or may rely on a secondary power supply for power. Substance switch 36' may also be activated or powered by the presence or absence of a static magnetic field. For example, line 78 attached to proximity sensor 76 may operate as a plunger for activating the substance switch 36'. In this arrangement, at least one of the proximity target 62' and proximity sensor 76 may be formed of a magnetic material. Positioning proximity target 62' in the vicinity of proximity sensor 76, such as may occur when attaching accessory device 14' to host 12', the proximity sensor 76 will be displace toward proximity target 62' due to the magnetic attraction of the two components. This in turn will withdraw plunger line 78 and activate substance switch 36'. Plunger line 78 may be biased toward substance switch 36', which will enable the substance switch 36' to be deactivated when accessory device 14' is detached from host 12'.

Figure 10:
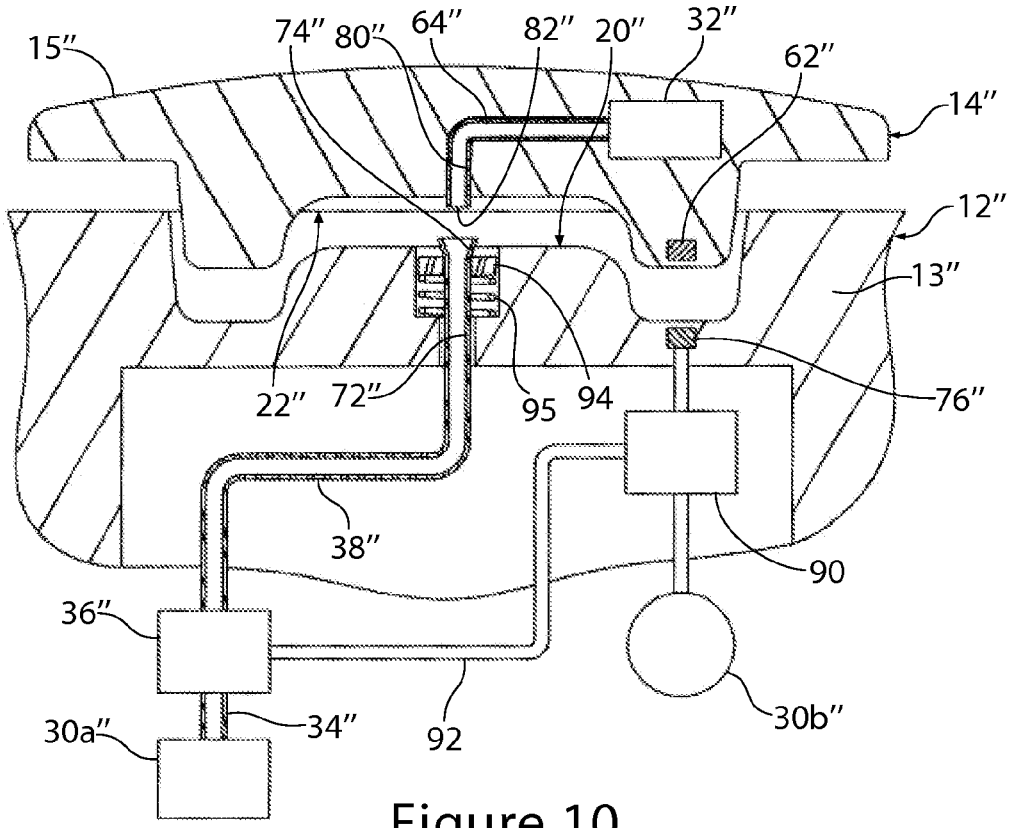
FIG. 10 is a partial cross-sectional view of a modular system according to a third embodiment of the invention employing a proximity sensor enabled substance communication coupling system using a powered proximity switched valve, and showing an accessory device portion of the substance communication coupling system positioned for engagement with a host portion of the substance communication coupling system.
Figure 11:
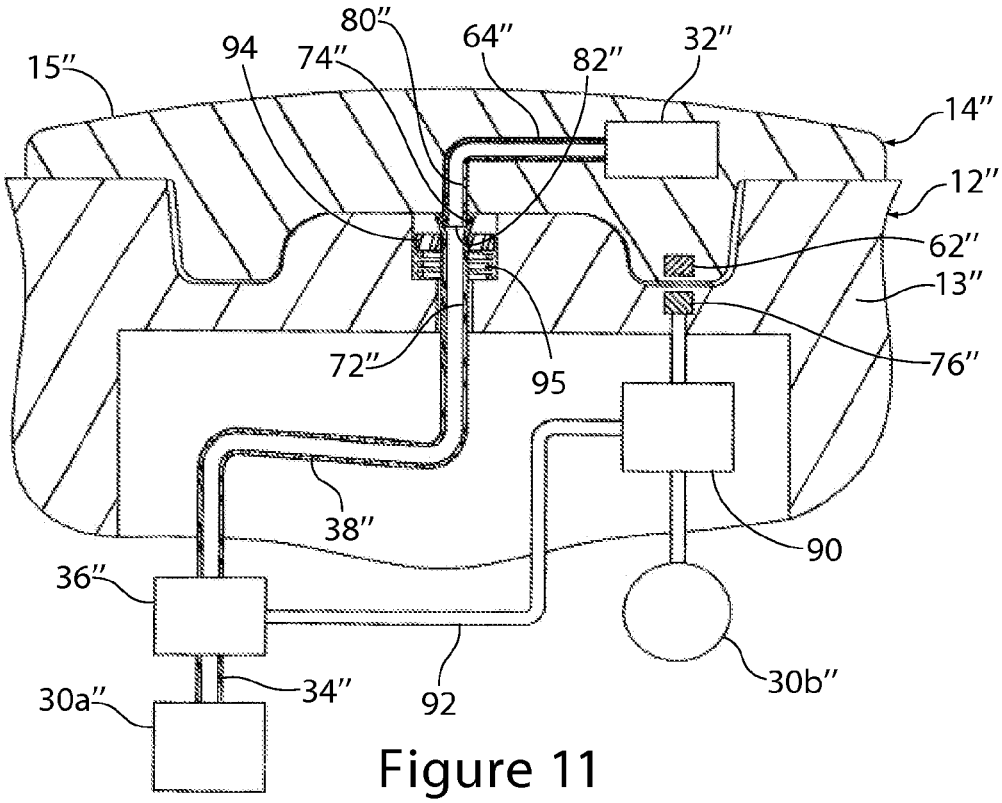
FIG. 11 is a partial cross-sectional view similar to FIG. 10, showing the accessory device portion of the substance communication coupling system engaged with the host portion of the substance communication coupling system.

Referring to FIGS. 10 and 11, a modular system according to a third embodiment of the invention is shown and comprises a host 12" having a substance communication coupling component 20" and an accessory device 14" having a substance communication coupling component 22", where elements in common with the other embodiments are denoted by the same reference numeral bearing a double prime (") symbol. The drawings illustrate an approach to a switched substance communication coupling system wherein a substance switch 36" or a proximity sensor 76" are powered independently of the substance provider providing the substance for the substance consumer. In particular, host 12" may include a substance provider **30*a*" connected by a first substance line 34" to a substance switch 36". A second substance line 38" extends from substance switch 36" through an aperture 72" in the housing 13" and terminates in a first interface 74". Host 12" may further be provided with a seal 94 protecting the aperture 72" from the substance being communicated. The host 12" may further be provided with a biasing member, such as a spring 95, for biasing the first interface 74" partially out of housing 13"**.

A proximity sensor 76" is associated with a sender 90. The sender 90 is powered by a service provider **30*b*", such as an electrical power supply, and is connected to the substance switch by a line 92 to selectively activate substance switch 36" in response to the detection of an appropriate proximity target. The communication along line 92 may, for example, be by means of an electrical signal, an acoustic or electromagnetic wave, pneumatic or hydraulic pressure, or a physical displacement of a linking member. The proximity sensor 76" may also be powered by service provider 30*b*" either directly or indirectly through the sender 90**.

The accessory device 14" may be provided with a substance consumer 32" connected to a substance line 64" extending through an aperture 80" in the housing 15" and terminating in a second interface 82" engageable with the first interface 74". The accessory device 14" is further provided with a proximity target 62" chosen for cooperation with the proximity sensor 76".

Coupling of accessory device 14" to host 12" can be accomplished by positioning accessory device 14" adjacent host 12" in such a manner that accessory substance communication coupling component 22" is generally aligned with host substance communication coupling component 20", as shown in FIG. 10. With substance communication coupling components 20" and 22" engaged, as shown in FIG. 11, proximity target 62" comes into the range of proximity sensor 76" and activates substance switch 36" to switch on the flow of substance from the substance provider 30" to the substance consumer 32". The spring 95 limits the movement of the first interface 74" against second interface 82" to facilitate a reliable seal between interfaces 74" and 82". Similarly, detaching accessory substance communication coupling component 22" from host substance communication coupling component 20" displaces proximity target 62" away from the proximity sensor 76" and releases the substance switch 36". The spring 95 may provide continued engagement of interfaces 74" and 82" to accommodate a small amount of relative displacement between substance communication coupling components 20" and 22".

Figure 12:
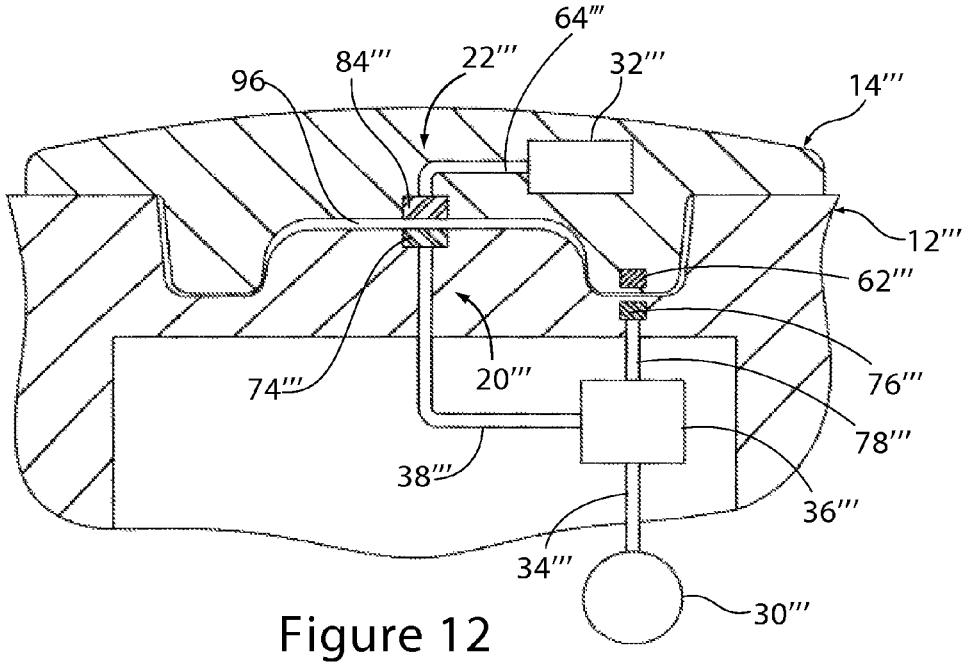
FIG. 12 is a partial cross-sectional view of a modular system according to a fourth embodiment of the invention employing a proximity sensor enabled substance communication coupling system for delivering a contactless substance, showing an auxiliary device portion of the substance communication coupling engaged with a host portion of the substance communication coupling.

Referring to FIG. 12, a modular system according to a fourth embodiment of the invention is shown and comprises a host 12' having a substance communication coupling component 20'" and an accessory device 14' having a substance communication coupling component 22', where elements in common with the other embodiments are denoted by the same reference numeral bearing a tripe prime (") symbol. The drawing illustrates a switched substance communication coupling system similar to that illustrated in FIG. 8 except that the substance delivered from the first interface 74" to the second interface 84" is delivered wirelessly or contactlessly. Therefore, no spring is required to be associated with either interface and it is acceptable to have a gap 96 between the interfaces 74" and 84" when the host substance communication coupling component 20'" and the device substance communication coupling component 22' are engaged.

Figure 13A:
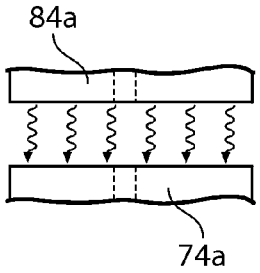
FIGS. 13A, 13B, and 13C schematically illustrate alternative non-contact substance communication pathways that may be used in conjunction with the proximity enabled substance communication coupling system of FIGS. 1 through 12.
Figure 13B:
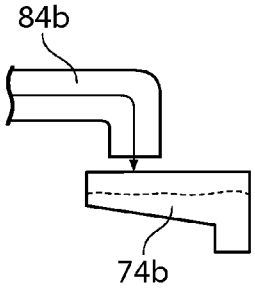
Figure 13C:
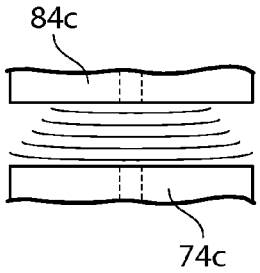

It will be appreciated that the substance lines or pathways of any of the previous embodiments need not be restricted to a tube or channel but may include a gap across which the substance may be passed. FIGS. 13A, 13B, and 13C schematically illustrate alternative non-contact substance communication pathways for use in conjunction with the substance communication coupling system described above and below herein through which a substance may be communicated. In general, these non-contact substance communication pathways rely upon a field, such as a gravity field, a magnetic field, and a heat radiation field, which is selectively generated in response to a proximity switch to assist in the transfer of substance As shown in FIG. 13A, a substance may be passed between interfaces 74*a* and 84*a* assisted by a temperature differential generated between the interfaces 74*a* and 84*a* in response to a proximity switch, such as the switch shown in FIG. 8. For example, the substance may be passes between interfaces 74*a* and 84*a* by way of sublimation mass transfer. Alternatively, radiant heat may be generated to heat the substance only upon activation of a proximity switch for transfer of a substance stored in one phase but transferable in another phase, such as a substance stored in solid phase and transferred in liquid phase or stored as a solid, liquid or gel and transferred in a gaseous phase.

Alternatively, as shown in FIG. 13B, substance may pass between an outlet associated with an interface 84*b* to an inlet associated with an interface 74*b* assisted by gravity. In this case, a proximity switch, such as the switch shown in FIG. 8, may operate a valve, not shown, to prevent the flow of substance to the outlet unless the interfaces are properly positioned in the manner described previously herein. Alternatively, a proximity switch may selectively operate a pump to deliver substance to interface 84*b*.

As shown in FIG. 13C, a substance may be made to pass between interfaces 74*c* and 84*c* assisted by an electromagnetic or acoustic field, which is generated only upon activation of a proximity switch, such as the switch shown in FIG. 8. In this instance, the substance is responsive to magnetism, electrical induction, or another field. For example, the substance may be magnetically responsive or may be subject to ionization and related ionic transfer from high potential interface to a low potential interface, such as in electrostatic deposition processes.

Figure 14:
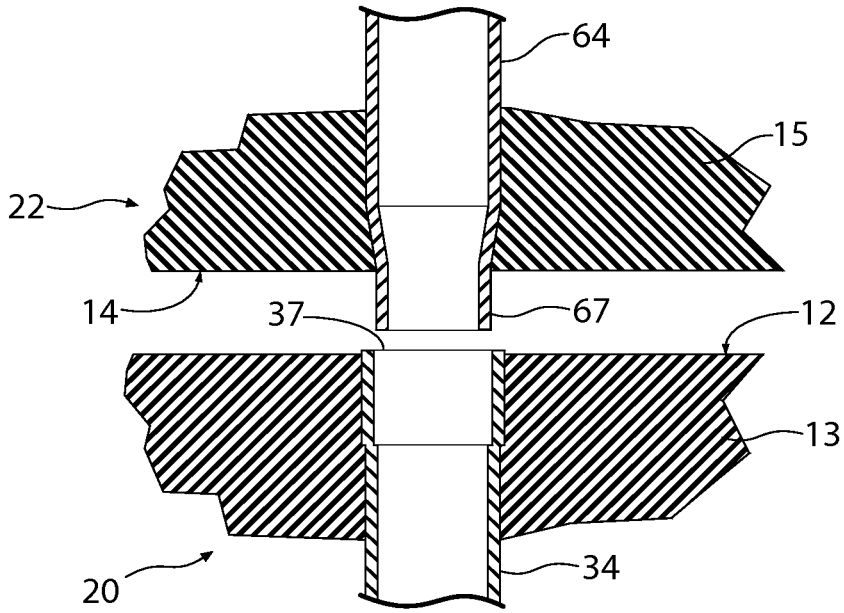
FIG. 14 is an enlarged cross-sectional view of a portion of a substance communication coupling system having alternative coupling components for sealing an accessory portion of the substance communication coupling system to a host portion of the substance communication coupling system.
Figure 15:
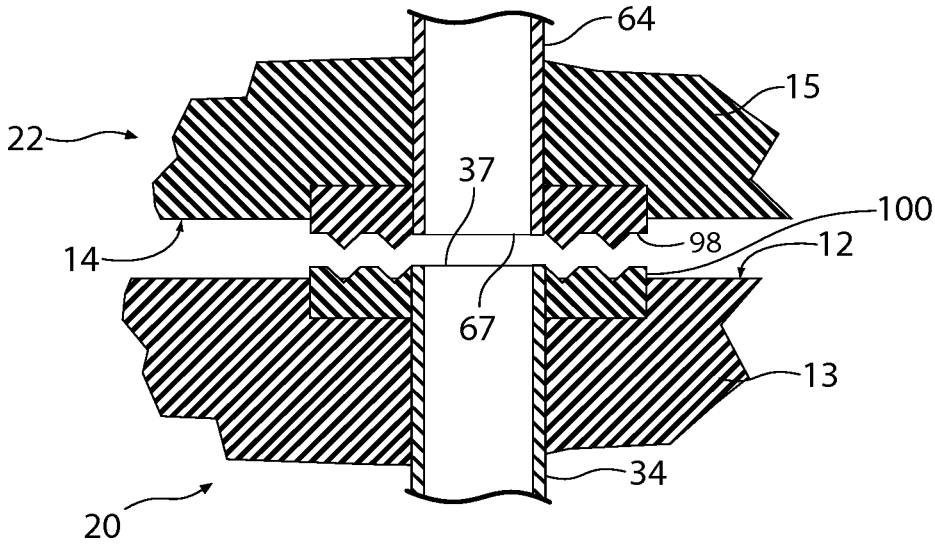
FIG. 15 is an enlarged cross-sectional view of a portion of another substance communication coupling system having alternative coupling components for sealing an accessory portion of the substance communication coupling system to a host portion of the substance communication coupling system.
Figure 16:
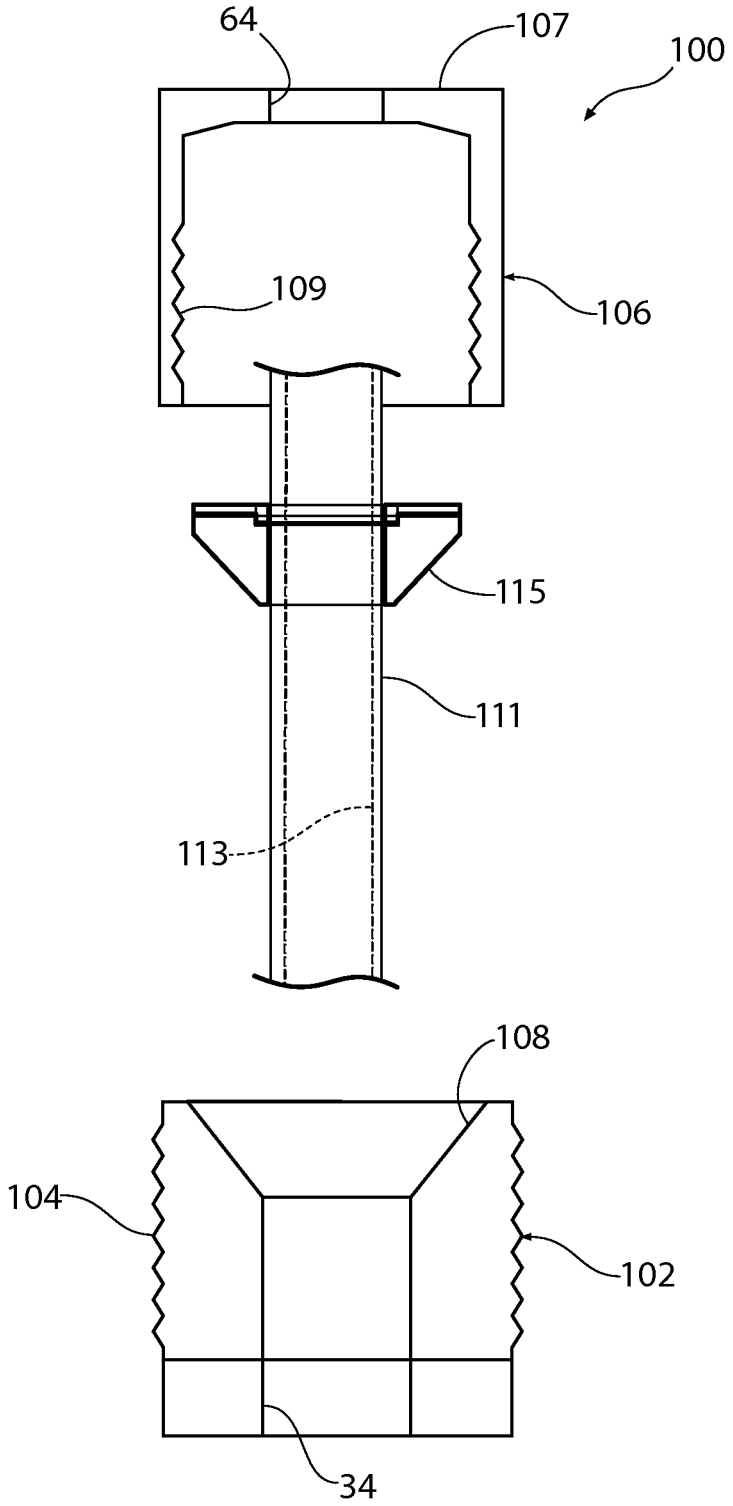
FIG. 16 schematically illustrates yet another substance communication coupling system having alternative coupling components for sealing an accessory portion of the substance communication coupling system to a host portion of the substance communication coupling system.

It will be appreciated that coupling components for sealing accessory substance communication coupling component 22 to host substance communication coupling component 20 will vary depending upon the type of substance being transferred and the pressures involved. Some systems, such as water systems may use compression fittings that may be completely reusable or partially reusable with the replacement of some components. FIGS. 14 through 16 schematically illustrated alternative coupling components for sealing the substance communication coupling components 20 and 22 when they are coupled together.

Referring to FIG. 14 a portion of a substance communication coupling system having alternative coupling components is illustrated, and comprises a host 12 having a substance communication coupling component 20 and an accessory device 14 having a substance communication coupling component 22. Accessory communication coupling component 22 may include a substance line 64 in communication with a substance consumer (not shown) having a tapered exposed end 67. Host substance communication coupling component 20 may include a substance line 34 in communication with a substance provider (not shown) having an enlarged exposed end 37. The tapered exposed end 67 may be compression fit into enlarged exposed end 37 to seal the substance communication coupling components 20 and 22 when they are coupled together.

Referring to FIG. 15, a portion of a substance communication coupling system having alternative coupling components is illustrated, and comprises a host 12 having a substance communication coupling component 20 and an accessory device 14 having a substance communication coupling component 22. Accessory communication coupling component 22 may include a substance line 64 in communication with a substance consumer (not shown) having an exposed end 67. Host substance communication coupling component 20 may include a substance line 34 in communication with a substance provider (not shown) having an exposed end 37. Gaskets 98 and 100 are respectively provided about the exposed ends 37 and 67. The gaskets 98 and 100 may be made of foam for a crush-type fit, which may be useful for substance communication involving gases. The gaskets 98 and 100 may be fit together to seal the substance communication coupling components 20 and 22 when they are coupled together.

In other installations, there may be simple threaded fittings, an example of which will be described subsequently. Still other systems, such as sealed systems for refrigeration, may use welds, brazes, and chemical bonding which are all meant to be permanent. It will be appreciated that for multiple make-break connections turning motion on gasket surfaces is avoided and compression is preferred.

Referring to FIG. 16, a portion of a substance communication coupling system 100 having alternative coupling components is illustrated, and employs a threaded fitting. The coupling system 100 may include a host interface 102 that may operably connect to substance line 34 connected to a substance source or substance provider (not shown). Host interface 102 may include a threaded boss 104 for accepting a device interface 106 associated with an accessory device. Substance line 34 terminates in a chamfered exposed end 108.

Device interface 106 comprising a cap 107 having a threaded inner surface 109 engageable with the threaded boss 104 of host interface 102. The coupling system 100 further includes a fluidic coupler 111 which may be coupled to substance line 64 leading to a substance consumer (not shown).

The fluidic coupler 111 may be an elongated pipe segment having a fluid passage 113 therethrough and a Swage-Lok™ type seal or a similar flexible seal 115.

Coupling of device interface 106 to host interface 102 can be accomplished by first passing the fluidic coupler 111 into substance line 34 until the flexible seal 115 abuts chamfered exposed end 108 of substance line 34. Next, cap 107 is rotatably driven by the user into engagement with the threaded boss 104 driving the flexible seal 115 into sealing engagement with chamfered exposed end 108 of substance line 34.

It shall be appreciated that any of the coupling systems illustrated in FIGS. 14 through 16 may be employed with any one of the substance communication coupling systems illustrated in FIGS. 6 through 12.

Figure 17:
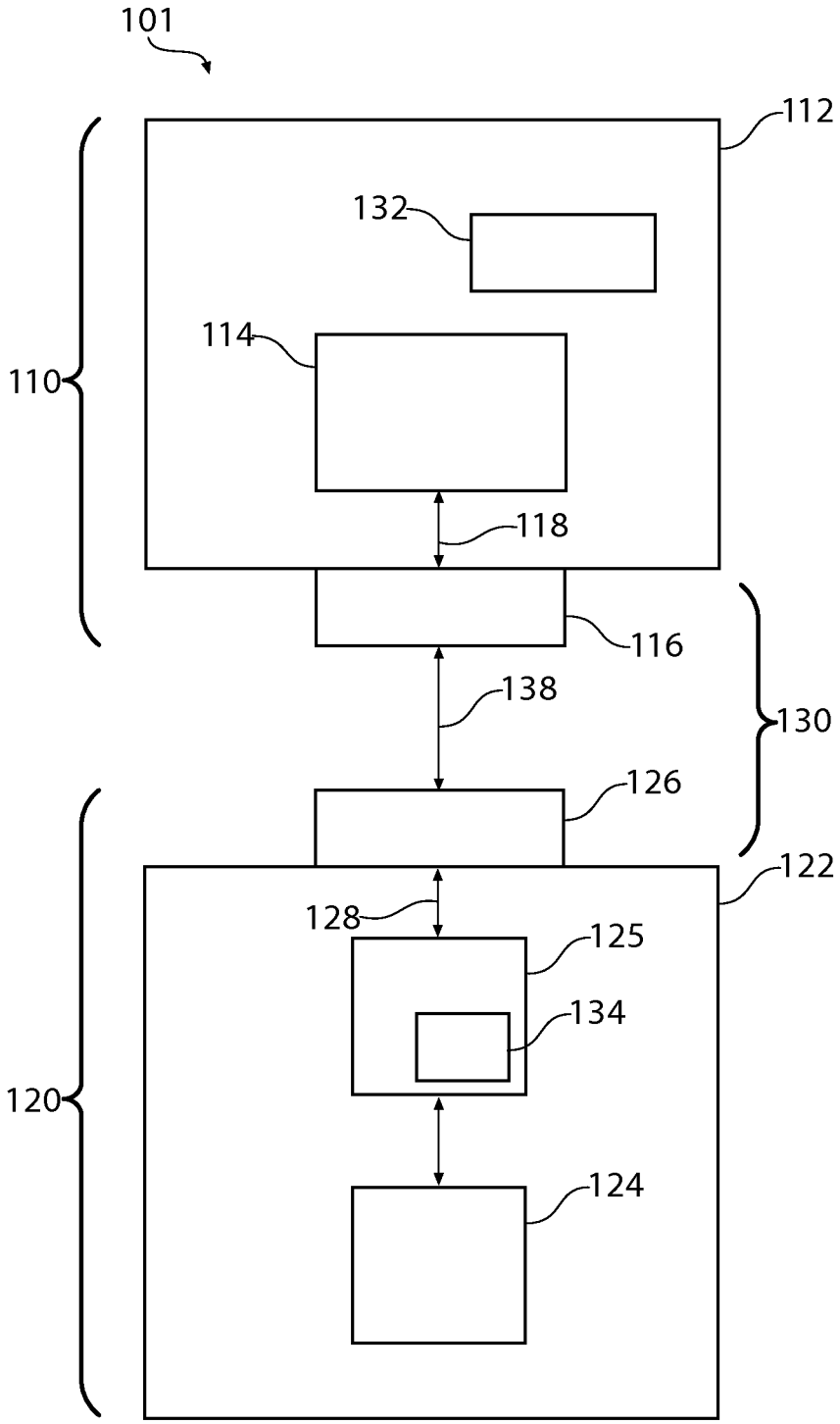
FIG. 17 schematically illustrates a substance provider and consumption system.

Referring to FIG. 17, a more general example of a substance provider and consumption system 101 is schematically illustrated. A first subsystem 110 is connectable to a second subsystem 120 for selectively transferring a substance between the subsystems 110 and 120. As illustrated, first subsystem 110 may include an accessory device 112 having a substance consumer 114 connected to a first substance communication component, such as a plug 116, by a substance line 118. Second subsystem 120 may include a host 122, such as a refrigerator, including a substance provider 124 connected to a second substance communication component, such as a receptacle 126, through a substance switch 125 by substance line 128.

A coupling system 130 includes plug 116 and receptacle 126 which are selectively interengageable. A proximity target 132 and a proximity sensor 134 are respectively associated with first subsystem 110 and second subsystem 120 to selectively activate the substance switch 125 when the plug 116 and receptacle 126 are engaged to permit the flow of the substance from the substance provider 124 to the receptacle 126, so that it may subsequently be provided along a substance line 138 between receptacle 126 and plug 116, and then along substance line 118 to substance consumer 114.

It will be appreciated that while host 122 is illustrated as including a substance provider, and accessory device 112 is illustrated as including a substance consumer, accessory device 112 may alternatively or additionally include a substance provider and host 122 may alternatively or additionally include a substance consumer. It will further be appreciated that while plug 116 is illustrated as being associated with substance consumer 114 and receptacle 126 is illustrated as being associated with substance provider 124, it is contemplated that plug 116 and receptacle 126 may be male or female coupling system components so long as the components are capable of interengaging to permit the transfer of substance there between.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A substance communication coupling system comprising:

a first substance communication coupling component capable of being associated with a substance consumer;

a contactless proximity target associated with at least one of the first substance communication coupling component and the substance consumer;

a second substance communication coupling component operably engageable with the first substance communication coupling component, the second substance communication coupling component capable of being associated with a substance source;

a contactless proximity sensor associated with at least one of the second substance communication coupling component and the substance source;

a substance pathway between the first and second substance communication coupling components when the first and second substance communication coupling components are interengaged, the substance pathway is capable of passing a substance between the first and second substance communication coupling components; and a substance switch operably associated with the contactless proximity sensor to selectively permit the flow of the substance along the substance pathway when the contactless proximity sensor detects the contactless proximity target;

wherein the substance switch selectively opens the substance pathway in response to the detection of the contactless proximity target by the contactless proximity sensor; and wherein the contactless proximity sensor is slidably disposed within the substance pathway.

2. The system according to claim 1, wherein one of the first and second substance communication coupling components comprises a substance plug and the other of the first and second substance communication coupling components comprises a substance receptacle.

3. The system according to claim 1, wherein the substance switch selectively permits the flow of substance to the substance pathway in response to the detection of the contactless proximity target by the contactless proximity sensor.

4. The system according to claim 1, wherein the contactless proximity sensor is movable between a first position, in which the substance is substantially blocked from passing through the substance pathway between the first and second substance communication coupling components, and a second position, in which the substance is allowed to pass through the substance pathway between the first and second substance communication coupling components.

5. The system according to claim 4, wherein the contactless proximity sensor is arranged in the first position when the contactless proximity sensor does not detect the contactless proximity target.

6. The system according to claim 4 and further comprising a biasing member connected to the contactless proximity sensor, the biasing member urging the contactless proximity sensor toward the first position.

7. The system according to claim 4, wherein the contactless proximity target and the contactless proximity sensor are magnetic and the substance switch comprises the contactless proximity sensor, the contactless proximity sensor responding to the detection of the contactless proximity target by moving away from the first position toward the second position.

8. The system according to claim 1, wherein the contactless proximity target and the contactless proximity sensor are magnetic and the substance switch responds to movement of the contactless proximity sensor in response to the detection of the contactless proximity target by the contactless proximity sensor.

9. The system according to claim 1 and further comprising a host configured to communicate the substance to the substance consumer.

10. The system according to claim 9, wherein the host comprises at least one of a refrigerator, a freezer, a conventional oven, a microwave oven, a dishwashing machine, a stove, a range, an air conditioner, a dehumidifier, a clothes washing machine, a clothes dryer, a clothes refreshing machine, a non-aqueous washing apparatus, a water softener, a water heater, a furnace, pool water treatment equipment, an HVAC system, a thermostat, a blender, a mixer, a toaster, a coffee maker, an air purifier, an iron, a vacuum cleaner, a robot, a trash compactor, or a structural feature of a building.

11. The system according to claim 10 and further comprising a portable functional device comprising the substance consumer.

12. The system according to claim 1, wherein the contactless proximity sensor is selected from a magnetic sensor, a light sensor, an optical sensor, an eddy current sensor, an acoustic sensor, an electromagnetic sensor, a chemical sensor and a thermal sensor.

13. The system according to claim 1, wherein the contactless proximity target is selected from a passive target and an active target.

14. The system according to claim 1, wherein the contactless proximity sensor is selected from a passive sensor and an active sensor.

15. The system according to claim 1, wherein the substance comprises a consumable substance.

16. The system according to claim 1, wherein the substance pathway comprises a field directing the movement of the substance.

17. The system according to claim 1, wherein the substance pathway comprises a tube.

18. A substance communication coupling system for connecting a portable device having a contactless proximity target to a host and a substance source capable of supplying a substance, the substance communication coupling system comprising:

a substance communication coupling component;

a contactless proximity sensor capable of detecting the contactless proximity target;

a substance pathway interconnecting the substance source and the substance communication coupling component; and a substance switch selectively permitting the flow of the substance along the substance pathway in response to the detection of the contactless proximity target by the contactless proximity sensor:

wherein the substance switch selectively forms the substance pathway in response to the detection of the contactless proximity target by the contactless proximity sensor; and wherein the contactless proximity sensor is slidably disposed within the substance pathway.

19. The system according to claim 18, wherein the substance pathway comprises a field directing the movement of the substance.

20. The system according to claim 18, wherein the substance pathway comprises a tube.

21. The system according to claim 18, wherein the substance communication coupling system further comprises the substance source.

22. The system according to claim 18, wherein the contactless proximity sensor is movable between a first position, in which the substance is substantially blocked from passing through the substance pathway, and a second position, in which the substance is allowed to pass through the substance pathway.

23. The system according to claim 22, wherein the contactless proximity sensor is arranged in the first position when the contactless proximity sensor does not detect the contactless proximity target.

24. The system according to claim 22 and further comprising a biasing member connected to the contactless proximity sensor, the biasing member urging the contactless proximity sensor toward the first position.

25. The system according to claim 22, wherein the contactless proximity target and the contactless proximity sensor are magnetic and the substance switch comprises the contactless proximity sensor, the contactless proximity sensor responding to the detection of the contactless proximity target by moving away from the first position toward the second position.

26. The system according to claim 18, wherein the substance switch responds to movement of the contactless proximity sensor in response to the detection of the contactless proximity target by the contactless proximity sensor.

27. The system according to claim 18, wherein at least one of the contactless proximity target and the contactless proximity sensor is a magnet.

28. The system according to claim 18, wherein the contactless proximity sensor responds to detection of the contactless proximity target by sending a signal to the substance switch.

29. The system according to claim 28, wherein the signal comprises at least one of an electrical signal, a change in voltage, a change in current, a change in frequency, a change in resistance, a change in reactance, a mechanical signal, a change in pressure, or a displacement vibration.

30. The system according to claim 18 and further comprising a host configured to communicate the substance, wherein the host comprises at least one of a refrigerator, a freezer, a conventional oven, a microwave oven, a dishwashing machine, a stove, a range, an air conditioner, a dehumidifier, a clothes washing machine, a clothes dryer, a clothes refreshing machine, a non-aqueous washing apparatus, a water softener, a water heater, a furnace, pool water treatment equipment, an HVAC system, a thermostat, a blender, a mixer, a toaster, a coffee maker, an air purifier, an iron, a vacuum cleaner, a robot, a trash compactor, or a structural feature of a building.

31. The system according to claim 18, wherein the contactless proximity sensor is configured to detect at least one of magnetism, an electromagnetic wave, an acoustic wave, a visual target or a chemical component.

32. The system according to claim 18, wherein the contactless proximity target comprises a magnet, the contactless proximity sensor comprises a magnet, and the substance switch is powered at least partially by the magnetic interaction between the contactless proximity sensor and the contactless proximity target.

33. The system according to claim 32, wherein the substance switch is powered by the mechanical movement of the contactless proximity sensor in response to the magnetic interaction between the contactless proximity sensor and the contactless proximity target.

34. An accessory having a first substance consumer for use in association with a host having a second substance consumer, a first substance communication coupling component, a substance conduit selectively providing a substance to the first substance communication coupling component, and a contactless proximity sensor slidably disposed within the substance conduit, the accessory comprising:

a second substance communication coupling component;

a substance pathway for interconnecting the first substance consumer and the second substance communication coupling component; and a contactless proximity target capable of activating the contactless proximity sensor to activate a substance switch, wherein the substance conduit selectively provides a substance to the first substance communication coupling component in response to the sliding of the contactless proximity sensor by the contactless proximity target.

35. The accessory according to claim 34 and further comprising a housing wherein the first substance consumer, the substance pathway and the contactless proximity target are each at least partially disposed within the housing.

36. The accessory according to claim 34 and further comprising an adapter, the first substance consumer further comprising a functional device capable of being removably coupled to the adapter.

37. The accessory according to claim 34, wherein the contactless proximity target provides at least one of magnetism, an electromagnetic wave, an acoustic wave, a visual target, or a chemical component.

38. The accessory according to claim 34, wherein the contactless proximity target is selected from a passive target and an active target.

39. The accessory according to claim 34, wherein the contactless proximity target is a magnet.

40. An adapter for removably coupling a portable device having a first device substance communication coupling component to a host having a substance provider, a first host substance communication coupling component, a first substance pathway selectively providing a substance to the first substance communication coupling component, a contactless proximity sensor slidably disposed within the first substance pathway, and a substance switch, the adapter comprising:

a second host substance communication coupling component engageable with the first host substance communication coupling component;

a second device substance communication coupling component engageable with the first device substance communication coupling component;

a second substance pathway interconnecting the second host substance communication coupling component and the second device substance communication coupling component for the transfer of a substance there along; and a contactless proximity target capable of activating the contactless proximity sensor to activate the substance switch, wherein the substance switch is selectively activated in response to the sliding of the contactless proximity sensor by the contactless proximity target to permit the first substance pathway to provide the substance to the first substance communication coupling component.

41. The adapter according to claim 40, wherein the contactless proximity target provides at least one of magnetism, an electromagnetic wave, an acoustic wave, a visual target, or a chemical component.

42. The adapter according to claim 40, wherein the contactless proximity target is selected from a passive target and an active target.

* * * * *